US006825917B2

(12) United States Patent
Ozaki

(10) Patent No.: US 6,825,917 B2
(45) Date of Patent: Nov. 30, 2004

(54) IMAGE EXPOSURE APPARATUS

(75) Inventor: Takao Ozaki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/212,044

(22) Filed: Aug. 6, 2002

(65) Prior Publication Data

US 2002/0186360 A1 Dec. 12, 2002

Related U.S. Application Data

(63) Continuation of application No. 09/693,983, filed on Oct. 23, 2000, now Pat. No. 6,456,366.

(30) Foreign Application Priority Data

Oct. 21, 1999 (JP) ..... 11-299091

(51) Int. Cl.[7] ..... G03B 27/04; G03B 27/32
(52) U.S. Cl. ..... 355/85; 355/27; 101/138
(58) Field of Search ..... 355/85, 104, 27, 355/18; 399/139, 177; 400/629; 101/477, 138; 396/575

(56) References Cited

U.S. PATENT DOCUMENTS

| | | | | |
|---|---|---|---|---|
| 4,268,158 A | | 5/1981 | Naganuma et al. | |
| 4,328,749 A | * | 5/1982 | Inouye et al. | 101/138 |
| 4,498,758 A | | 2/1985 | Nelen | |
| 4,611,905 A | | 9/1986 | De Schamphelaere et al. | |
| 5,479,858 A | * | 1/1996 | Beisel et al. | 101/477 |
| 5,893,003 A | * | 4/1999 | Allen | 396/575 |
| 5,931,589 A | * | 8/1999 | Kamano et al. | 400/629 |

FOREIGN PATENT DOCUMENTS

JP 5-278843 A 10/1993

* cited by examiner

*Primary Examiner*—Peter B. Kim
(74) *Attorney, Agent, or Firm*—Sughrue Mion, PLLC

(57) ABSTRACT

An image exposure apparatus whose installation area and height are reduced and which enables smooth conveying of a printing plate. The apparatus comprises a cassette accommodating portion for the accommodation of printing plates therein, wherein the printing plates are loaded so as to be inclined at a predetermined angle, preferably at an angle near 90°.

25 Claims, 12 Drawing Sheets

IMAGE EXPOSURE APPARATUS

This is a continuation of application Ser. No. 09/693,983 filed Oct. 23, 2000; now U.S. Pat. No. 6,456,366 the disclosure of which is incorporated herein by reference.

BACKGROUND OF THE INVENTION

1. Field of the Invention

The present invention relates to an image exposure apparatus in which a sheet material, such as a photosensitive planographic printing plate, is exposed so that an image is formed thereon.

2. Description of the Related Art

In general, a printing plate which includes a support formed of a thin aluminum plate and a photosensitive layer formed on the support is used in printing. After an image has been formed on this printing plate by exposure, the exposed printing plate is subjected to a development processing, and a printing plate which is ready for printing is thereby formed.

In an image exposure apparatus which carries out image exposure on this printing plate, a plurality of printing plates are loaded in a cassette in a superposed manner. These printing plates are taken out from this cassette one at a time and are subjected to image exposure. Further, the size of the printing plate is selected so as to correspond to the size of a material to be printed. For this reason, in the image exposure apparatus, image exposure can be performed on printing plates having different sizes (for example, those in the range of 1030 mm (length)×950 mm (width) to 500 mm×400 mm, or the like). Furthermore, the image exposure apparatus is structured in such a manner that printing plates having various sizes are loaded into a cassette, and after a printing plate having a desired size has been taken out from the cassette, image exposure is carried out on the printing plate.

One type of the image exposure apparatus is structured such that a printing plate is made to closely contact the outer peripheral surface of a rotating drum. In this type of the image exposure apparatus, while sub-scanning is carried out by rotating the printing plate together with the rotating drum, image exposure is carried out on the printing plate by a light beam emitted from an exposure head which is disposed opposite to the rotating drum.

The support of the printing plate has a thickness of 0.3 mm and therefore is very thin, and the photosensitive layer is brittle. For this reason, when the printing plate is curved at a small curvature, cracks or the like are inevitably formed in the photosensitive layer. Accordingly, in the image exposure apparatus in which image exposure is carried out in such a manner that the printing plate is wound onto the outer peripheral surface of the rotating drum, the printing plate which has been taken out from the cassette needs to be conveyed such that, as far as possible, the printing plate is not curved.

For example, in a conventional image exposure apparatus 200 illustrated in FIG. 12A, cassette loading sections 206A and 206B are disposed adjacent to a recording section 204 which effects image exposure on a printing plate 202. A plate-supplying conveyor 208 is disposed at the upper side of the cassette loading sections 206A and 206B. The plate-supplying conveyor 208 conveys, in a substantially horizontal manner, the printing plate 202 which is taken out from the cassettes 210 each loaded in the cassette loading sections 206A or 206B, and supplies the printing plate 202 to the recording section 204.

A plate-discharging conveyor 212 is disposed above the plate-supplying conveyor 208. The plate-discharging conveyor 212 conveys the printing plate 202 which has been taken out from the recording section 204 after completion of image exposure and sends it out to an automatic development apparatus 214 which is provided outside the image exposure apparatus 200. The image exposure apparatus 200 is an inner spinner type in which the printing plate 202 is exposed while closely contacting the inner peripheral surface of a drum 216.

In the image exposure apparatus 200 in FIG. 12A, by loading the cassettes 210 at a relatively gentle angle (at an angle close to 180°) and conveying the printing plate 202 substantially horizontally by the plate-supplying conveyor 208, image exposure can be carried out while curving of the printing plate 202 is suppressed. Moreover, the height of the apparatus 200 can be made relatively low.

On the other hand, in an image exposure apparatus 220 shown in FIG. 12B, a cassette loading section 224 is provided adjacent to a recording section 222. Cassettes 226 are disposed substantially upright at the cassette loading section 222. Plate-supplying carriers 228 and a plate-discharging carrier 230 are provided so as to convey printing plates 202 in a substantially upright manner.

In the image exposure apparatus 220 in FIG. 12B, the printing plate 202 which has been pulled out upward from the cassette 226 is conveyed by the plate-supplying carrier 228 and supplied to the recording section 222. Further, the printing plate 202 which has been subjected to image exposure is pulled upwards from the recording section 222, and is held and discharged to the outside of the apparatus 220 by the plate-discharging carrier 230. In this image exposure apparatus 220, the printing plate 202 is wound onto the outer peripheral surface of a rotating drum 232 which is provided at the recording section 222, and scanning exposure is effected on the printing plate 202 by rotating the printing plate 202 together with the rotating drum 232.

This image exposure apparatus 220 is structured such that the cassettes 226 are loaded substantially upright in the cassette loading section 224. Therefore, the installation space for the apparatus 220 can be made small.

In both the image exposure apparatuses 200 and 220, the printing plate 202 is curved while image exposure is carried out, and is made straight when conveyed.

However, as in the image exposure apparatus 200, in case of a structure in which the printing plate 202 is conveyed so as to be substantially horizontal, the height of the apparatus is low, but a considerably large installation space is necessary. Further, as in the image exposure apparatus 220, in case of a structure in which the printing plate 202 is conveyed so as to be substantially upright, the installation space for the apparatus is relatively small, but the height of the apparatus is considerably high. Namely, there is a drawback in that both the conventional apparatuses are large.

Further, when the printing plate which has been subjected to image exposure is taken out from the recording section and is sent out to a device for the next process such as an automatic development device, the printing plate needs to be sent out at a speed which corresponds to the speed at which the printing plate is conveyed in the device for the next process. Therefore, a space in which the printing plate is temporarily stored after image exposure thereof is needed inside the image exposure apparatus. This storage space may be an obstacle to making the apparatus compact.

As a technique relating to the present invention, Japanese Patent Application Laid-Open (JP-A) No. 5-278843 discloses a printing plate conveying apparatus which connects a printing apparatus to a development apparatus. This apparatus includes a rotating section for rotating a printing plate on a horizontal surface, a belt conveying section for conveying the printing plate in a horizontal direction, and a roller conveying section for conveying the printing plate in an opposite horizontal direction. In order to make it possible to change the conveying direction by 90°, the structure of this apparatus is large and very complicated.

SUMMARY OF THE INVENTION

An aspect of the present invention is an image exposure apparatus for carrying out image exposure on a sheet material, comprising: a recording section which records an image on the sheet material by exposing the sheet material; an accommodating section which is disposed adjacent to the recording section and accommodates a plurality of sheet materials in such a manner that the plurality of sheet materials are inclined at a predetermined angle (θ) relative to a horizontal plane; and a diverting section which is disposed above the accommodating section, and diverts the sheet material received from the accommodation section and conveys it to the recording section. In this apparatus, the sheet materials are accommodated in an inclined manner, and therefore, the accommodating section, and as a result, the installation area for the apparatus can be made small. Moreover, since the sheet material is diverted (the direction of the sheet material is changed), the height of the apparatus can be reduced.

The angle θ of the sheet material is preferably in the range greater than or equal to 45° to less than 90°. Preferably, the accommodating section can accommodate a plurality of cassettes disposed parallel to each other, each of the plurality of cassettes being able to accommodate the plurality of sheet materials. It is preferable that the diverting section can be selectively moved to respective positions each corresponding to an exit for sheets above the cassette. In this case, since the sheet materials can be smoothly and reasonably taken out from the plurality of cassettes, the processing capacity can be considerably improved. The diverting section preferably diverts the sheet material by conveying it in such a manner that the sheet material is curved at a predetermined radius of curvature. In this case, since the curvature of the curve of the sheet material is constant, the sheet material is not easily damaged. Preferably, the diverting section includes a diverting roller which is rotated for diverting the sheet material, and the sheet material is wound onto the outer peripheral surface of the diverting roller. In this case, the curvature of the curve of the sheet material is set by the radius of the diverting roller, and the sheet material can therefore be curved at a constant radius of curvature. The radius of the diverting roller is preferably small, but can be freely set as long as damages or the like are not caused on the sheet material. Preferably, the diverting section includes an endless conveying belt which is wound onto a predetermined range of the circumference of the diverting roller so that the sheet material is nipped between the diverting roller and the conveying belt and is conveyed thereby. In this case, since the sheet material is uniformly nipped (pressed) and smoothly curved, damages such as folds, bends, or the like of the sheet material are not easily caused. The range of the endless conveying belt which is wound onto the diverting roller preferably varies in accordance with the position of the diverting section which is selectively moved above the accommodating section. Preferably, the image exposure apparatus further comprises a discharging section which is disposed above the recording section for diverting the sheet material received from the recording section and discharging the sheet material to the outside of the apparatus. The sheet material preferably includes a support and a photosensitive layer formed on the support.

Another aspect of the present invention is an image exposure apparatus for carrying out image exposure on a sheet material, comprising: a recording section which records an image on the sheet material by exposing the sheet material; an accommodating section which is disposed adjacent to the recording section and accommodates a plurality of sheet materials in such a manner that the plurality of sheet materials are inclined at an angle (θ) in a range greater than or equal to 45° to less than 90° relative to a horizontal plane; and a diverting section which is disposed above the accommodating section, and diverts the sheet material received from the accommodation section by conveying it in such a manner that the sheet material is curved at a predetermined radius of curvature, and conveys the sheet material to the recording section. In this apparatus, since the sheet material is conveyed in such a manner that the sheet material is curved at a predetermined curvature, the possibility of damages being caused on the sheet material can be reduced.

Preferably, the diverting section includes a diverting roller which is rotated for diverting the sheet material, and the sheet material is wound onto the outer peripheral surface of the diverting roller. The diverting section preferably includes an endless conveying belt which is wound onto a predetermined range of the circumference of the diverting roller so that the sheet material is nipped between the diverting roller and the conveying belt and is conveyed thereby. It is preferable that the diverting section can be horizontally moved above the accommodating section, and the range of the conveying belt which is wound onto the diverting roller varies in accordance with the moving position of the diverting section. Preferably, the apparatus further comprises a discharging section which is disposed above the recording section for diverting the sheet material received from the recording section and discharging the sheet material to the outside of the apparatus.

Yet another aspect of the present invention is an image exposure apparatus for carrying out image exposure on a sheet material, comprising: a recording section which records an image on the sheet material by exposing the sheet material; an accommodating section which is disposed adjacent to the recording section and can accommodate a plurality of sheet materials; a diverting section which diverts the sheet material received from the accommodation section and conveys the sheet material to the recording section; and a discharging section which is disposed above the recording section for diverting the sheet material received from the recording section and discharging the sheet material to the outside of the apparatus. In this apparatus, especially the discharging section can be structured in a compact manner. Further, the installation area for and the height of the apparatus can be reduced.

Preferably, the discharging section diverts the sheet material by conveying it in such a manner that the sheet material is curved at a predetermined radius of curvature. The discharging section preferably includes a discharging roller which is rotated for diverting the sheet material, and the sheet material is wound onto the outer peripheral surface of the discharging roller. The discharging section preferably includes an endless conveying belt which is wound onto a predetermined range of the circumference of the discharging roller so that the sheet material is nipped between the discharging roller and the conveying belt and is conveyed thereby. It is preferable that the range of the endless conveying belt wound onto the discharging roller is no less than a half of the circumference of the discharging roller.

DESCRIPTION OF THE PREFERRED EMBODIMENTS

Figure 1:
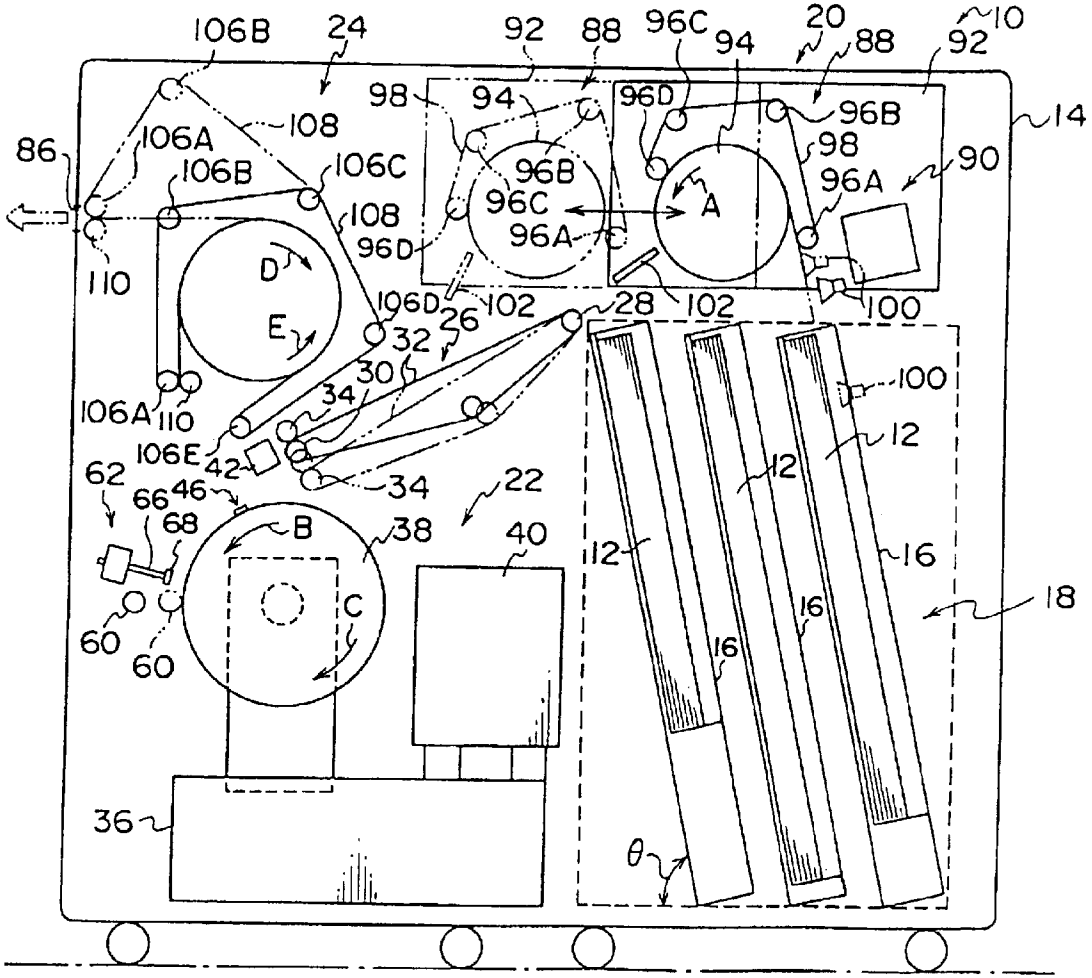
FIG. 1 is a schematic structural diagram showing an image exposure apparatus to which the present invention is applied.

Referring now to the attached drawings, an embodiment of the present invention will be described hereinafter. FIG. 1 shows a schematic structure of an image exposure apparatus 10 used in the present embodiment. The image exposure apparatus 10 carries out exposure by irradiating, onto a photosensitive planographic printing plate (hereinafter referred to as a "printing plate 12"), a light beam which is modulated based on image data. The printing plate 12 includes a thin, rectangular plate of aluminum or the like (for example, a plate having a thickness of about 0.3 mm) and a photosensitive layer formed thereon. The printing plate 12 which has been subjected to image exposure in the image exposure apparatus 10 is then subjected to a development processing and the like in an unillustrated automatic development apparatus and the like so as to complete the formation of a press plate for printing.

Provided inside a machine frame 14 of the image exposure apparatus 10 are a cassette loading section 18 in which cassettes 16 each accommodating the printing plates 12 therein are loaded, a plate supplying and conveying section 20 which takes out the printing plates 12 from the cassettes 16 one at a time and sends them out for the next process, a recording section 22 which effects image exposure on the printing plates 12, and a discharging buffer section 24 which discharges the printing plates 12, whose image exposure has been completed, synchronously with the speed at which the printing plates 12 are to be conveyed in the next process.

The cassette loading section 18 is disposed inside the machine frame 14 at the lower right side of the page in FIG. 1. A plurality of cassettes 16 each accommodating the printing plates 12 in a superposed manner are loaded in the cassette loading section 18 so as to be inclined. In the image exposure apparatus 10, the cassettes 16 are accommodated in such a way that they are inclined so as to be almost perpendicular to the bottom of the apparatus 10. In this way, the plurality of cassettes 16 can be loaded in a small space. The angle θ of inclination of the cassette 16 with respect to the horizontal direction is preferably in the range greater than or equal to 45° to less than 90°, and more preferably in the range greater than or equal to 60° to less than 90°.

In the image exposure apparatus 10, the printing plates 12 having various sizes and different longitudinal and transverse dimensions can be processed, such as those of 1030 mm×950 mm, 745 mm×620 mm, 500 mm×400 mm, and the like. A printing plate 12 of any size is accommodated in the cassette 16 in such a manner that the photosensitive layer of the printing plate 12 faces up and one end of the printing plate 12 is positioned at a predetermined position. Further, the cassette 16 is loaded in the cassette loading section 18 such that one end of the printing plate 12 is at a predetermined height.

The plate supplying and conveying section 20 is disposed above the cassette loading section 18. The plate supplying and conveying section 20 pulls out the printing plate 12 from the cassette 16 which is loaded in the cassette loading section 18 and sends out the printing plate 12 to the recording section 22 which is disposed adjacent to the cassette loading section 18.

The conveyor 26 is disposed above the recording section 22. In this conveyor 26, a conveying belt 32 is wound around a roller 28 disposed below and adjacent to the plate supplying and conveying section 20, and a roller 30 disposed above and adjacent to the recording section 22. The conveying belt 32 is inclined so that the roller 30 side is lower than the roller 28 side. The printing plate 12 is sent by the plate supplying and conveying section 20 onto the conveying belt 32 of the conveyor 26.

In the conveyor 26, a roller 30 and a roller 34 are disposed facing each other. By the conveying belt 32 being driven to rotate by unillustrated driving means, the printing plate 12 is conveyed by the conveying belt 32 toward the recording section 22 and is nipped by the rollers 30 and 34.

In the recording section 22, a rotating drum 38 and a recording head 40 are mounted on a mount 36. The rotating drum 38 is rotated by unillustrated driving means in a direction in which the printing plate 12 is mounted and exposed (i.e., in a direction of arrow B in FIG. 1) and in a direction in which the printing plate 12 is taken out (i.e., in a direction of arrow C). In the recording section 22, image exposure is carried out in the following manner. The printing plate 12 is wound onto the outer peripheral surface of the rotating drum 38. Then, while the printing plate 12 is rotated at a high speed together with the rotating drum 38 in the direction in which the printing plate 12 is mounted and exposed, the printing plate 12 is irradiated with a light beam which is emitted from the recording head 40 and modulated in accordance with image data.

Figure 5:
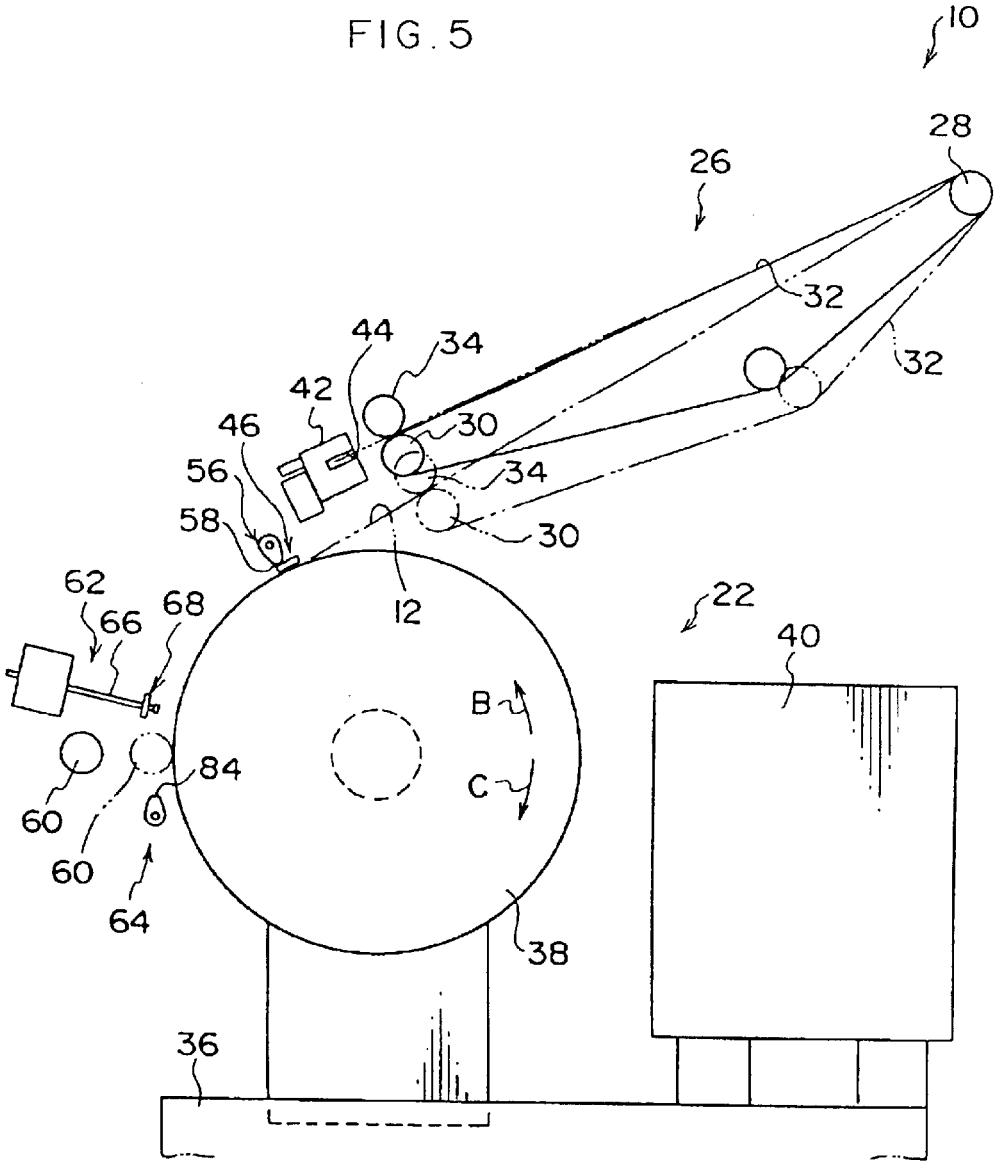
FIG. 5 is a schematic structural diagram showing a conveyor and vicinities of the recording section.

In the image exposure apparatus 10, a puncher 42 is disposed above the rotating drum 38. As shown in FIG. 5, an opening for holding 44 is formed at the conveyor 26 side of the puncher 42. In the conveyor 26, when the printing plate 12 is placed on the conveying belt 32, the rollers 30 and 34 are disposed facing the opening for holding 44 of the puncher 42. As the printing plate 12 is conveyed by the conveying belt 32, the leading end portion of the printing plate 12 is nipped by the rollers 30 and 34 and is inserted into the opening for holding 44. Further, once the leading end of the printing plate 12 is inserted into the opening for holding 44 of the puncher 42, driving of the conveying belt 32 is stopped.

The puncher 42 forms, in predetermined positions of the leading end portion of the printing plate 12 inserted into the opening for holding 44, notches or punching holes for positioning by an unillustrated punching blade. As shown in FIG. 3B, in the image exposure apparatus 10 used in the present embodiment, notches 43A and 43B are formed by the puncher 42 and are used for positioning the printing plate 12 when the printing plate 12 is subjected to image exposure.

The conveyor 26 includes unillustrated swinging means. As shown in FIGS. 1 and 5, the conveyor 26 is moved downwards by this swinging means so that the roller 30 side of the conveyor 26 approaches the rotating drum 38 of the recording section 22 with the roller 28 serving as an axis.

In the image exposure apparatus 10, after the notches 43A and 43B are formed in the leading end portion of the printing plate 12, the leading end portion is pulled out of the opening for holding 44 of the puncher 42 by driving the conveying belt 32 in the opposite direction, and then the conveyor 26 is made to swing. In this way, the leading end of the printing plate 12 is directed toward a predetermined position of the peripheral surface of the rotating drum 38.

A leading end chuck 46 is mounted at a predetermined position of the outer peripheral surface of the rotating drum 38. The rotating drum 38 is stopped at such a position that the leading end chuck 46 faces the leading end of the printing plate 12 disposed on the conveyor 26 which is swung downwards (this position is hereinafter referred to as the "printing plate mounting position").

Figure 3A:
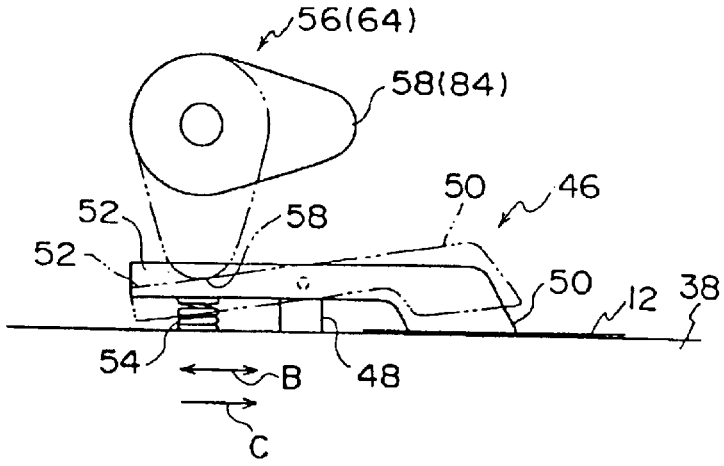
FIG. 3A is a schematic view showing a leading end chuck as seen along an axial direction of a rotating drum.
Figure 3B:
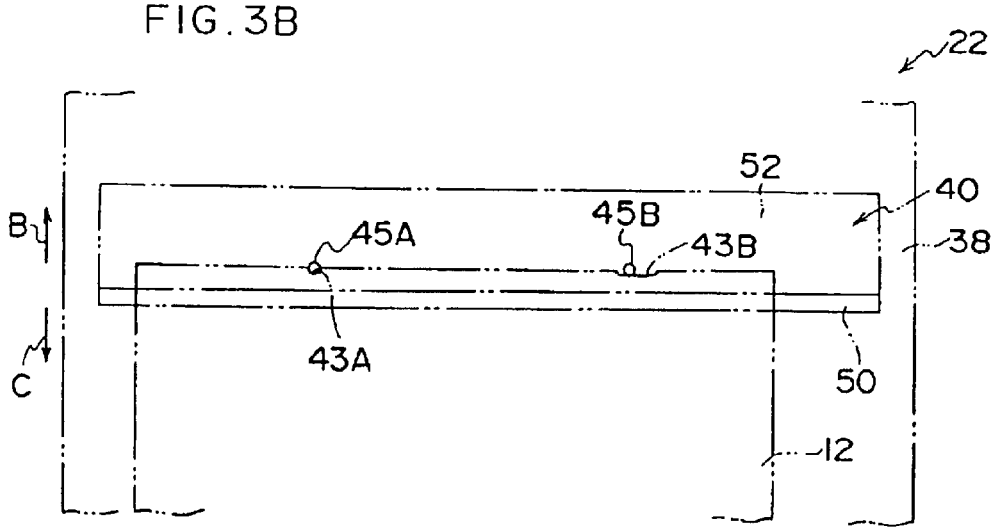
FIG. 3B is a schematic view of the rotating drum as seen in an outward radial direction thereof, showing the positioning of the leading edge of the printing plate on the rotating drum.

As shown in FIG. 3A, a spindle 48 is disposed at an intermediate portion of the leading end chuck 46 along the direction in which the rotating drum 38 is rotated, and the leading end chuck 46 is mounted via this spindle 48 to the rotating drum 38. The leading end chuck 46 has a clamp portion 50 at one end and a holding portion 52 at the other end thereof in a circumferential direction of the rotating drum 38, with the spindle 48 serving as a fulcrum. Moreover, the leading end chuck 46 is structured so that the clamp portion 50 thereof can swing, with the spindle 48 serving as a fulcrum, toward and away from the peripheral surface of the rotating drum 38.

The leading end chuck 46 has a spring 54 which is disposed between the holding portion 52 and the peripheral surface of the rotating drum 38. The leading end chuck 46 is structured so that the leading end of the printing plate 12 can be nipped between the clamp portion 50 and the peripheral surface of the rotating drum 38 by the biasing force of the spring 54.

In the recording section 22, a mounting cam 56 is disposed at a predetermined position in the vicinity of the peripheral surface of the rotating drum 38. When the rotating drum 38 is stopped at the printing plate mounting position, the holding portion 52 of the leading end chuck 46 faces the mounting cam 56. The mounting cam 56 is an eccentric cam, and by the mounting cam 56 being rotated by unillustrated rotating means, a cam surface 58 presses the holding portion 52 of the leading end chuck 46 against the biasing force of the spring 54. As a result, the clamp portion 50 of the leading end chuck 46 is spaced away from the peripheral surface of the rotating drum 38 against the biasing force of the spring 54, and a state is held in which the leading end of the printing plate 12 can be inserted between the clamp portion 50 and the rotating drum 38 or pulled out therefrom (see the two dot chain line in FIG. 3A).

In the image exposure apparatus 10, the conveyor 26 with the printing plate 12 placed thereon is operated while the clamp portion 50 of the leading end chuck 46 is open (i.e., while the clamp portion 50 is spaced away from the peripheral surface of the rotating drum 38), and conveys the printing plate 12 toward the peripheral surface of the rotating drum 38. In this way, the leading end of the printing plate 12 is inserted between the clamp portion 50 of the leading end chuck 46 and the rotating drum 38.

In the image exposure apparatus 10, once the leading end of the printing plate 12 is inserted between the clamp portion 50 and the rotating drum 38, the mounting cam 56 is rotated so that the cam surface 58 is spaced away from the holding portion 52 of the leading end chuck 46. As a result, in the leading end chuck 46, the leading end portion of the printing plate 12 is nipped and held between the clamp portion 50 and the rotating drum 38 by the biasing force of the spring 54.

Figure 6A:
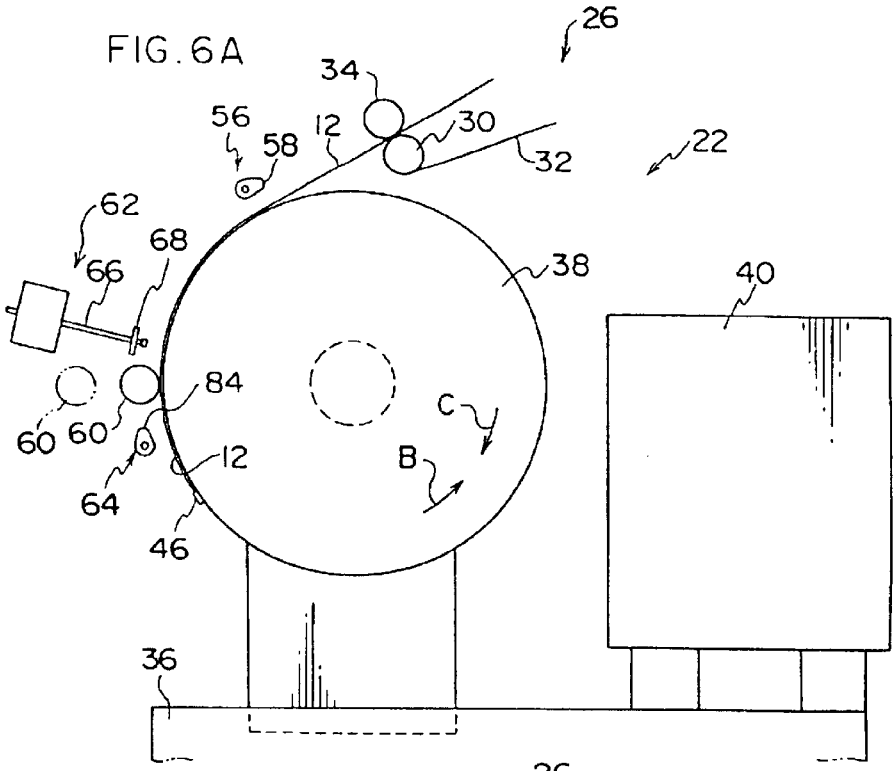
FIG. 6A is a schematic structural diagram showing the recording section at the time the leading end portion of the printing plate is wound onto the rotating drum.

As shown in FIG. 6A, in this state, by the rotating drum 38 being rotated in a direction in which the printing plate 12 is mounted and exposed, at a speed corresponding to the speed at which the printing plate 12 is conveyed by the conveying belt 32, the printing plate 12 is wound onto the peripheral surface of the rotating drum 38.

As shown in FIG. 3B, pins 45A and 45B for positioning the printing plate 12 are provided at the rotating drum 38. By the pins 45A and 45B being inserted into the notches 43A and 43B, respectively, the printing plate 12 inserted between the clamp portion 50 and the rotating drum 38 is positioned relative to the rotating drum 38 in a direction in which the printing plate 12 is conveyed (i.e., the circumferential direction of the rotating drum 38) and in a transverse direction (i.e., an axial direction of the rotating drum 38).

As shown in FIGS. 1 and 5, in the recording section 22, a squeeze roller 60 is disposed in the vicinity of the peripheral surface of the rotating drum 38 and downstream of the mounting cam 56 in the direction in which the rotating drum 38 is rotated so that the printing plate 12 is mounted and exposed on the rotating drum 38. This squeeze roller 60 is moved toward the peripheral surface of the rotating drum 38 by unillustrated means for disposing the squeeze roller 60 to contact or move away from the rotating drum 38. In this way, the printing plate 12 wound onto the rotating drum 38 is nipped between the squeeze roller 60 and the rotating drum 38.

At the time of mounting the printing plate 12 onto the rotating drum 38, when the leading end chuck 46 passes a position at which the leading end chuck 46 faces the squeeze roller 60, the squeeze roller 60 is moved toward the peripheral surface of the rotating drum 38, and the printing plate 12 is nipped between the squeeze roller 60 and the rotating drum 38. In this way, the printing plate 12 is wound onto the rotating drum 38 while being squeezed and is made to closely contact the peripheral surface of the rotating drum 38.

Further, in the recording section 22, a rear end mounting and dismounting unit 62 is disposed at the upstream side of the squeeze roller 60, and a detaching cam 64 is disposed at the downstream side of the squeeze roller 60 in the direction in which the rotating drum 38 is rotated so that the printing plate 12 is mounted and exposed on the rotating drum 38.

In the rear end chuck mounting and dismounting unit 62, a rear end chuck 68 is detachably mounted to the leading end of a mounting and dismounting shaft 66 which projects toward the rotating drum 38.

Figure 4A:
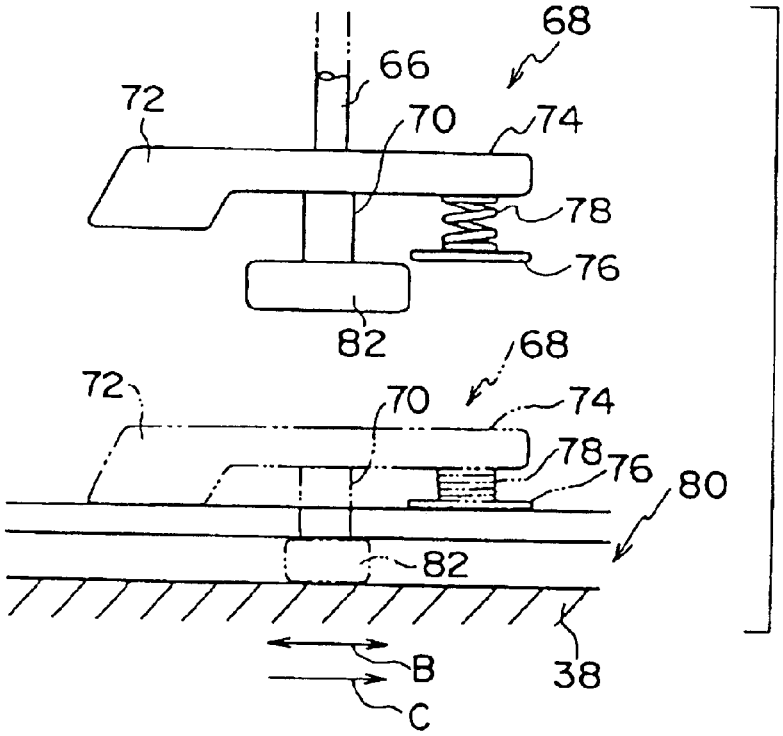
FIG. 4A is a schematic view showing mounting and dismounting of a rear end chuck as seen along the axial direction of the rotating drum.
Figure 4B:
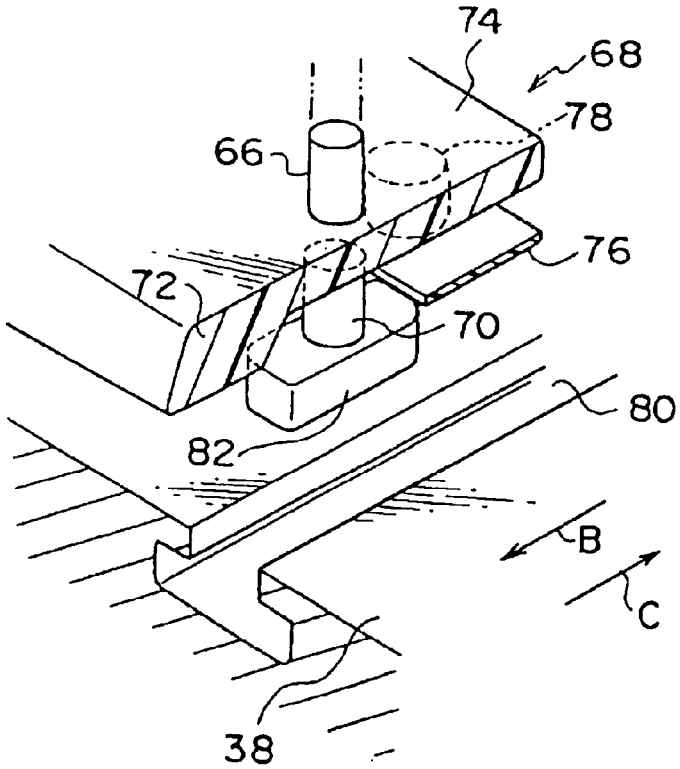
FIG. 4B is a schematic perspective view showing the main portion of the rear end chuck.

As shown in FIGS. 4A and 4B, a spindle 70 is disposed at an intermediate portion of the rear end chuck 68 in the directions in which the rotating drum 38 is rotated. Further, one end of the rear end chuck 68 serves as a clamp portion 72, and the other end as a holding portion 74, with the spindle 70 interposed therebetween. The rear end chuck 68 is mounted to the mounting and dismounting shaft 66 such that the clamp portion 72 is disposed toward the direction in which the rotating drum 38 is rotated so that the printing plate 12 is mounted and exposed on the rotating drum 38. Furthermore, an abutment plate 76 is disposed at the rotating drum 38 side of the holding portion 74, and is connected to the holding portion 74 via a spring 78.

On the other hand, a plurality of mounting grooves 80 are formed on the peripheral surface of the rotating drum 38. The mounting grooves 80 are formed at predetermined intervals in the axial direction of the rotating drum 38. A plurality of spindles 70 are provided at the rear end chuck 68 for the mounting grooves 80.

As shown in FIG. 4B, the mounting groove 80 is formed in such a manner that the cross-section (i.e., the cross-section taken along the axial direction of the rotating drum 38) thereof is substantially T-shaped. As shown in FIGS. 4A and 4B, a base portion 82 which is block-shaped and is inserted into the mounting groove 80 is mounted at the leading end portion of the spindle 70. By the base portion 82 being inserted into the mounting groove 80 and rotated inside the mounting groove 80 at an angle of substantially 90°, the base portion 82 abuts the inner wall surface of the mounting groove 80 and is prevented from being dismounted from the mounting groove 80 or being moved in a longitudinal direction of the mounting groove 80.

Figure 6B:
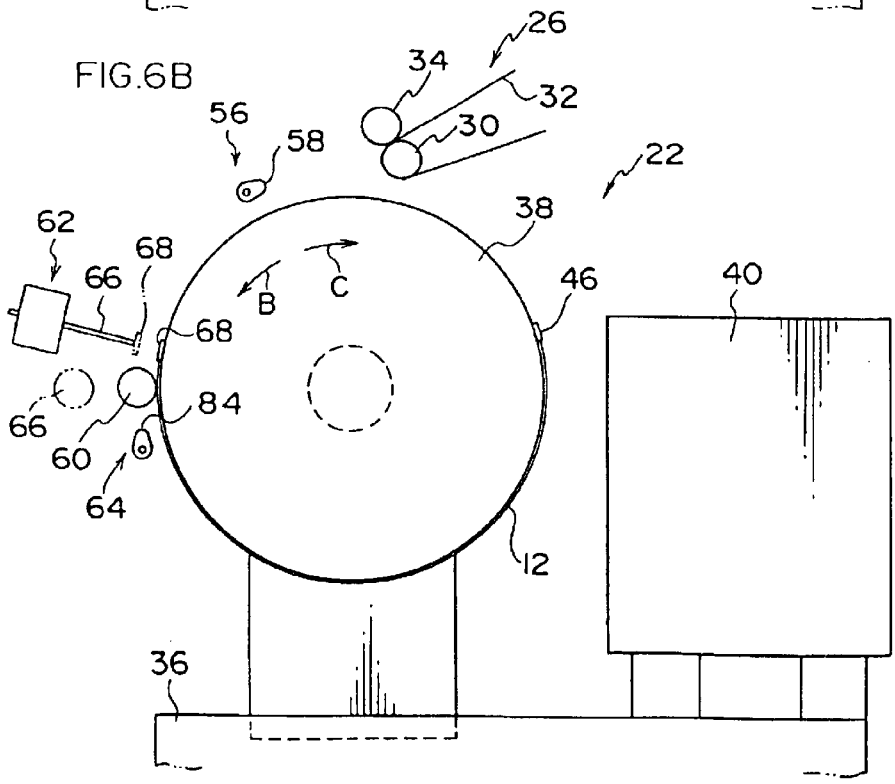
FIG. 6B is a schematic structural diagram showing the recording section at the time the rear end portion of the printing plate is held on the rotating drum.

As illustrated in FIG. 6B, in the image exposure apparatus 10, when an unillustrated sensor detects that the rear end of the printing plate 12 wound onto the rotating drum 38 has reached a position at which the rear end faces the rear end chuck 68 which is mounted to the mounting and dismounting shaft 66, the rotating drum 38 is stopped. Subsequently, the rear end chuck mounting and dismounting unit 62 moves the mounting and dismounting shaft 66 toward the rotating drum 38 such that the base portion 82 of the rear end chuck 68 is inserted into the mounting groove 80 of the rotating drum 38. Then, by rotating the mounting and dismounting shaft 66 in a predetermined direction, the base portion 82 is rotated within the mounting groove 80 together with the spindle 70, and the rear end chuck 68 is thereby mounted onto the rotating drum 38. The mounting and dismounting shaft 66 is disengaged from the spindle 70 by rotating the base portion 82. In this way, the mounting and dismounting shaft 66 can be dismounted from the spindle 70.

By the rear end chuck 68 being mounted onto the rotating drum 38, the abutment plate 76 of the holding portion 74 abuts the peripheral surface of the rotating drum 38. As a result, the holding portion 74 is biased by the biasing force of the spring 78 so as to be away from the rotating drum 38. Further, the clamp portion 72 of the rear end chuck 68 faces the rear end portion of the printing plate 12. By the holding portion 74 being biased by the spring 78, the rear end portion of the printing plate 12 is nipped and held between the clamp portion 72 and the rotating drum 38.

When the rear end chuck 68 is mounted onto the rotating drum 38, the mounting and dismounting shaft 66 is retracted by the rear end chuck mounting and dismounting unit 62 so as to be away from the rotating drum 38. When the rear end chuck 68 is mounted onto the rotating drum 38, the squeeze roller 60 is spaced away from the rotating drum 38 so that interference with the rotating drum 38 is prevented. Moreover, in order to bring the printing plate 12 in close contact with the peripheral surface of the rotating drum 38, a suction groove may be formed in the peripheral surface of the rotating drum 38 such that the printing plate 12 is sucked onto the peripheral surface of the rotating drum 38 by negative pressure supplied to the suction groove.

In the image exposure apparatus 10, the leading end portion and the rear end portion of the printing plate 12 are held on the peripheral surface of the rotating drum 38 by the leading end chuck 46 and the rear end chuck 68, respectively. Then, scanning exposure is carried out on the printing plate 12 by a light beam emitted from the recording head 40 while the rotating drum 38 is rotated at a high speed in the direction in which the printing plate 12 is mounted and exposed.

Figure 7A:
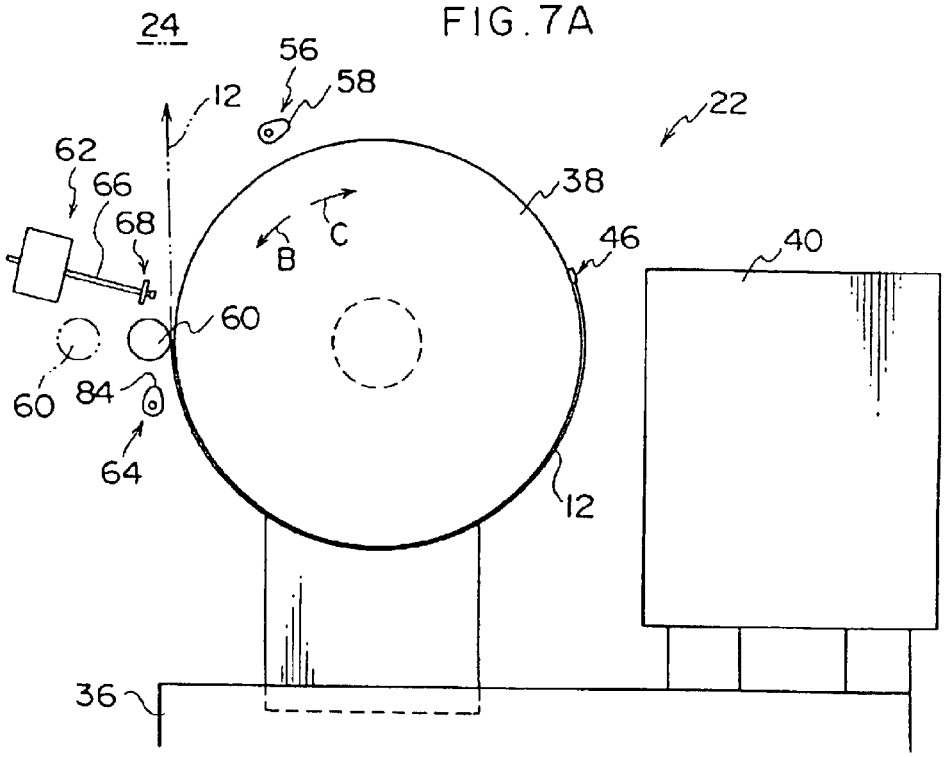
FIG. 7A is a schematic structural diagram showing the recording section at the time the rear end portion of the printing plate is sent out therefrom.

Further, as shown in FIG. 7A, in the recording section 22, when the scanning exposure on the printing plate 12 is completed, the rear end chuck 68 is stopped at a position at which the rear end chuck 68 faces the mounting and dismounting shaft 66 of the rear end chuck mounting and dismounting unit 62. The rear end portion of the printing plate 12 is nipped between the squeeze roller 60 and the rotating drum 38, and at the same time, the mounting and dismounting shaft 66 is extended and inserted into the rear end chuck 68. Subsequently, the mounting and dismounting shaft 66 is rotated substantially 90° in a direction opposite to the direction in which the rear end chuck 68 is mounted on the rotating drum 38, and is retracted when the base portion 82 can be dismounted from the mounting groove 80. In this way, the rear end chuck 68 is dismounted from the rotating drum 38, and the rear end of the printing plate 12 is released from the rear end chuck 68 and is held only by the squeeze roller 60.

As shown in FIG. 1, the discharging buffer section 24 is disposed above the squeeze roller 60. By the rotating drum 38 being rotated in the direction in which the printing plate 12 is taken out (i.e., in the direction of arrow C), the printing plate 12 with the rear end thereof released from the rear end chuck 68 is sent out from between the rotating drum 38 and the squeeze roller 60 toward the discharging buffer section 24 (see FIG. 7A).

Figure 7B:
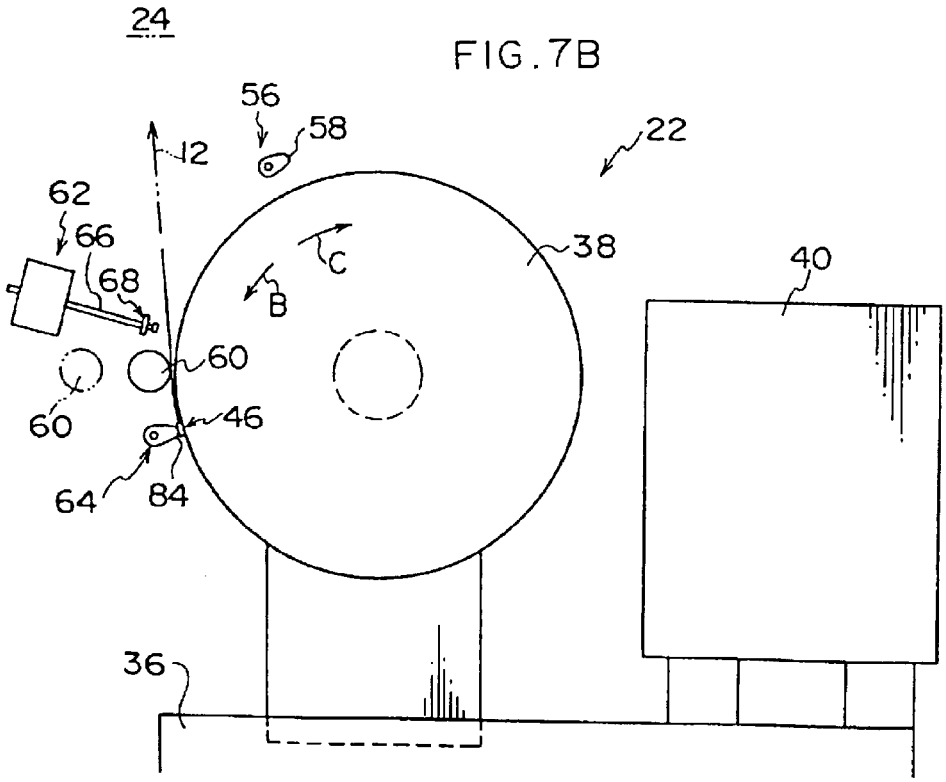
FIG. 7B is a schematic structural diagram showing the recording section at the time the leading end portion of the printing plate is removed therefrom.

On the other hand, as shown in FIG. 7B, in the recording section 22, when the leading end chuck 46 holding, on the rotating drum 38, the leading end of the printing plate 12 which is to be sent out toward the discharging buffer section 24, has reached a predetermined position at which the leading end chuck 46 faces the detaching cam 64, the rotating drum 38 is stopped. In this way, the holding portion 52 of the leading end chuck 46 faces a detaching cam 64.

As shown in FIG. 3A, as well as the mounting cam 56, the detaching cam 64 is an eccentric cam. By the detaching cam 64 being rotated by unillustrated rotating means, as shown in a two dot chain line, the holding portion 52 of the leading end chuck 46 is pressed against the biasing force of the spring 54 by a cam surface 84. As a result, the clamp portion 50 of the leading end chuck 46 is spaced away from the peripheral surface of the rotating drum 38, thereby releasing the holding of the printing plate 12. The printing plate 12 is pulled out from between the rotating drum 38 and the squeeze roller 60 to the discharging buffer section 24.

As illustrated in FIG. 1, the discharging buffer section 24 is disposed adjacent to a discharge port 86 formed in the machine frame 14. In the discharging buffer section 24, the printing plate 12 which has been sent out by the recording section 22 is temporarily accommodated and is subsequently sent out to the discharge port 86. In a case in which an automatic development apparatus (not shown) is disposed adjacent to the discharge port 86, the discharging buffer section 24 can send out the printing plate 12 at a speed corresponding to the speed at which the printing plate 12 is conveyed in the automatic development apparatus.

Figure 2A:
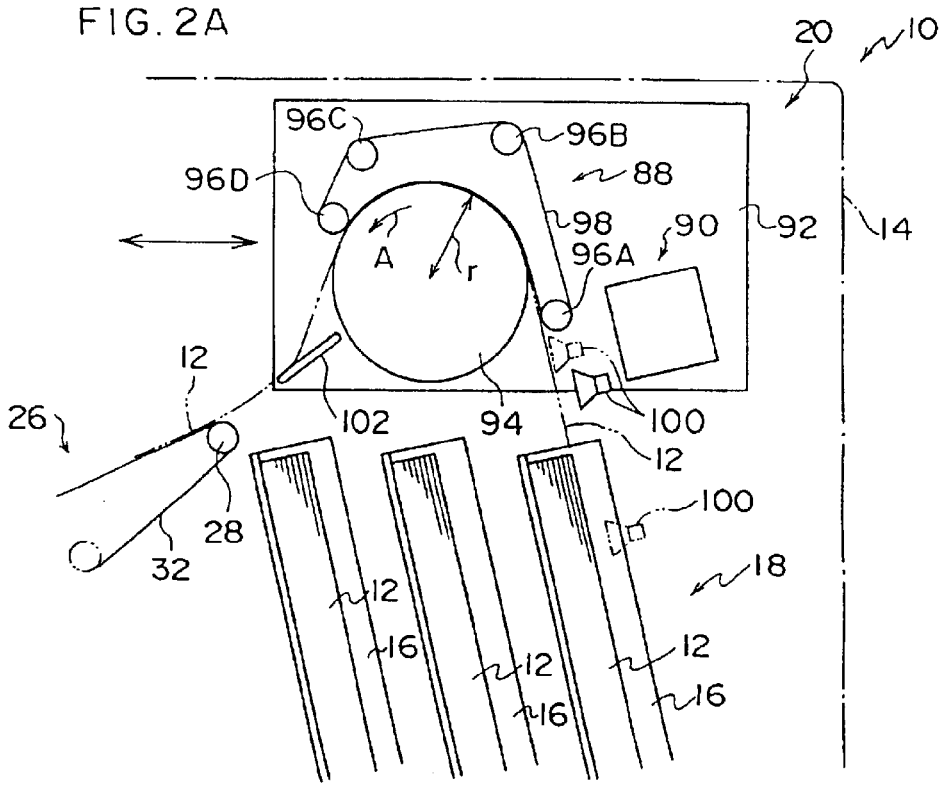
FIG. 2A is a schematic view showing how a printing plate is taken out from a cassette which is disposed at a machine frame side of a plate-supplying section.
Figure 2B:
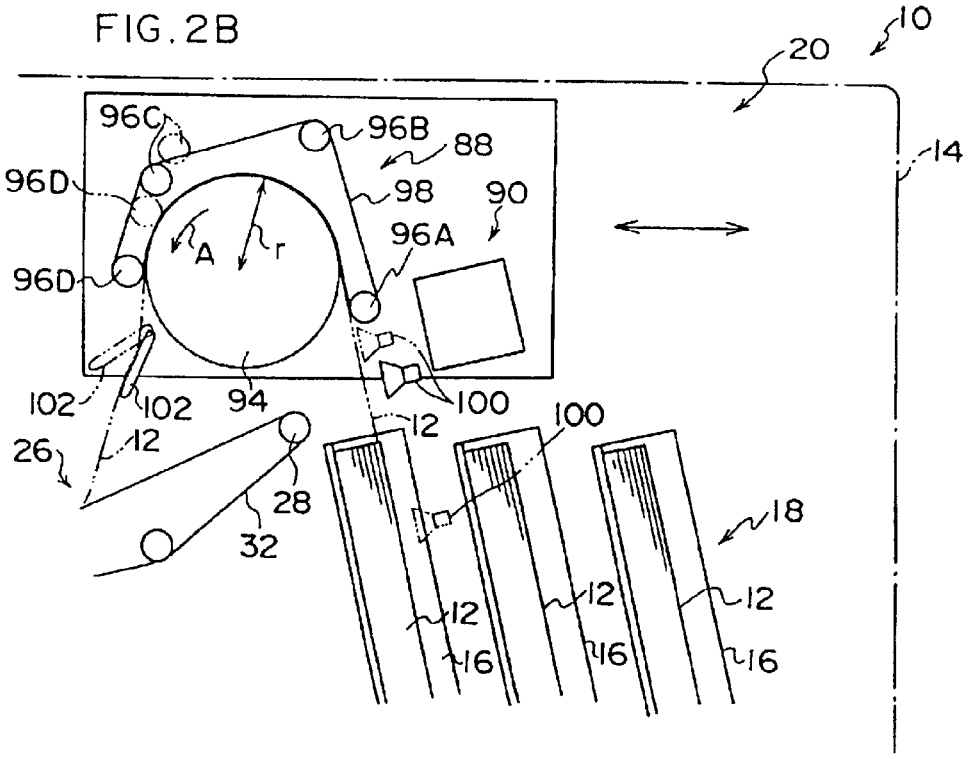
FIG. 2B is a schematic view showing how a printing plate is taken out from a cassette which is disposed at a recording section side of the plate-supplying section.

As shown in FIGS. 1, 2A and 2B, the plate supplying and conveying section 20 includes a diverting unit 88 and a sheet unit 90. A diverting roller 94 having a predetermined outer diameter is disposed at the diverting unit 88 between a pair of side plates 92 (only one of the side plates is shown in the respective drawings). Further, small rollers 96A, 96B, 96C and 96D are disposed around the diverting roller 94 in that order when seen from the cassette loading section 18.

The small roller 96A is disposed near the sheet unit 90 and so as to be lower than the center of axis of the diverting roller 94. Further, the small roller 96D is disposed near the conveyor 26 and so as to contact the diverting roller 94.

An endless conveying belt 98 is wound around these small rollers 96A, 96B, 96C and 96D. With this structure, the conveying belt 98 contacts the peripheral surface of the diverting roller 94 at the upper half of the circumference thereof between the small rollers 96A and 96D.

The diverting roller 94 is rotated, by unillustrated driving means for rotation, in a direction in which the printing plate 12 is pulled out from the cassette 16 (i.e., in a direction of arrow A). The conveying belt 98 is rotated in accordance with the rotation of the diverting roller 94.

The sheet unit 90 is mounted to the side plate 92. The sheet unit 90 includes a plurality of suckers 100 along the transverse direction of the printing plate 12 accommodated in the cassette 16 (i.e., along a direction perpendicular to the page surface in FIG. 1). Normally, these suckers 100 are each on standby at their original positions as shown in solid line in the respective drawings. When taking out of the printing plate 12 from the cassette 16 is instructed, the sheet unit 90 moves the suckers 100 to a printing plate sucking position where they face and suck the upper end portion of the printing plate 12 in the cassette 16 (this position is shown in dashed line in the respective drawings). Then, in this state, the sheet unit 100 moves the suckers 100 upwards toward the small roller 96A (shown in two dot chain line in the respective drawings).

As a result, the uppermost printing plate 12 is pulled out from the cassette 16, and the leading end of this printing plate 12 is inserted between the diverting roller 94 and the conveying belt 98. The suckers 100 suck the side of the printing plate 12 loaded in the cassette 16, on which side a photosensitive layer is formed. The printing plate 12 is fed between the diverting roller 94 and the conveying belt 98 such that the side of the printing plate 12 on which the photosensitive layer is formed contacts the conveying belt 98.

In the plate supplying and conveying section 20, the diverting roller 94 is driven synchronously with taking out of the printing plate 12 by the sheet unit 90, such that the printing plate 12 inserted between the diverting roller 94 and the conveying belt 98 is nipped thereby and moved along the periphery of the diverting roller 94 while being pulled out from the cassette 16. In the sheet unit 90, once the leading end of the printing plate 12 is nipped by the diverting roller 94 and the conveying belt 98, sucking of the printing plate 12 is released.

The printing plate 12 is nipped and conveyed by the diverting roller 94 and the conveying belt 98 in a curved manner along the periphery of the diverting roller 94, and is sent out from the small roller 96D toward the conveyor 26.

The radius r of the diverting roller 94 provided at this diverting unit 88 is determined so that, when the printing plate 12 is curved, no folds and tendency to curl are generated on the support of the printing plate 12 or no damages such as cracks or the like are caused on the photosensitive layer of the printing plate 12. In the present embodiment, the radius r is 100 mm (i.e., the diameter is 200 mm) as an example.

Moreover, the conveying belt 98 which contacts the photosensitive layer of the printing plate 12 is formed of a material such as woven fabric, non-woven fabric, artificial leather, teflon-containing rubber, or the like, so that the surface of the conveying belt 98 which contacts the photosensitive layer of the printing plate 12 is soft and very slippery. As a result, when the printing plate 12 is curved, no damages such as scratches are caused on the photosensitive layer of the printing plate 12, and the printing plate 12 can be uniformly pressed toward the peripheral surface of the diverting roller 94.

Unillustrated moving means is provided at the plate supplying and conveying section 20 so that the diverting unit 88 and the sheet unit 90 are integrally moved above the cassette loading section 18 in a substantially horizontal direction. Therefore, the sheet unit 90 is structured in such a manner that the printing plate 12 can be taken out from any of the cassettes 16 loaded in the cassette loading section 18. Further, the plate supplying and conveying section 20 is structured such that the printing plate 12 taken out by the sheet unit 90 is inserted between the diverting roller 94 and the conveying belt 98.

Namely, the side plates 92 are moved between a position shown in FIG. 2A at which the suckers 100 face the printing plate 12 in the cassette 16 loaded at the side of the machine frame 14 (i.e., the rightmost cassette in the drawing), and a position shown in FIG. 2B at which the suckers 100 face the printing plate 12 in the cassette 16 loaded at the side of the recording section 22 (i.e., the leftmost cassette in the drawing).

On the other hand, among the small rollers 96A, 96B, 96C and 96D provided at the diverting unit 88, the small rollers 96C and 96D disposed at the side of the conveyor 26 are structured so as to be moved along with the movement of the side plates 92. In other words, as shown in FIG. 2B, when the side plates 92 are moved from the position at which the suckers 100 face the cassette 16 disposed at the side of the machine frame 14 to the position at which the suckers 100 face the cassette 16 disposed at the side of the recording section 22, the small roller 96D is moved downwards along the peripheral surface of the diverting roller 94 (i.e., the small roller 96D is moved from the position shown in two dot chain line to the position shown in solid line). Along with the movement of the small roller 96D, the small roller 96C is moved from the position shown in two dot chain line to the position shown in solid line so as to impart a constant tension to the conveying belt 98.

In the diverting unit 88, the direction in which the printing plate 12 is sent out from between the diverting roller 94 and the conveying belt 98 is adjusted by moving the small roller 96D such that the printing plate 12 is reliably sent to the conveying belt 32 of the conveyor 26.

On the other hand, at the side plate 92 at which the diverting unit 88 is provided, a guide 102 is disposed substantially below the small roller 96D. The printing plate 12 is curved along the periphery of the diverting roller 94 while being nipped by the diverting roller 94 and the conveying belt 98, and is directed substantially downwards. Namely, the conveying direction of the printing plate 12 pulled out from the cassette 16 is changed by the printing plate 12 being nipped by the diverting roller 94 and the conveying belt 98 which are rotated in the direction in which the printing plate 12 is conveyed, and the leading end of the printing plate 12 is directed substantially downwards. The printing plate 12 with the leading end thereof directed downwards is sent out from between the small roller 96D and the diverting roller 94 toward the guide 102.

As shown in FIGS. 2A and 2B, the guide 102 is structured in such a manner that the leading end portion thereof is swung along with the horizontal movement of the diverting unit 88 and is directed toward the conveyor 26 all the time. The printing plate 12 is sent by the guide 102 onto the conveying belt 32 of the conveyor 26 and is conveyed on the conveying belt 32 toward the puncher 42.

Figure 8A:
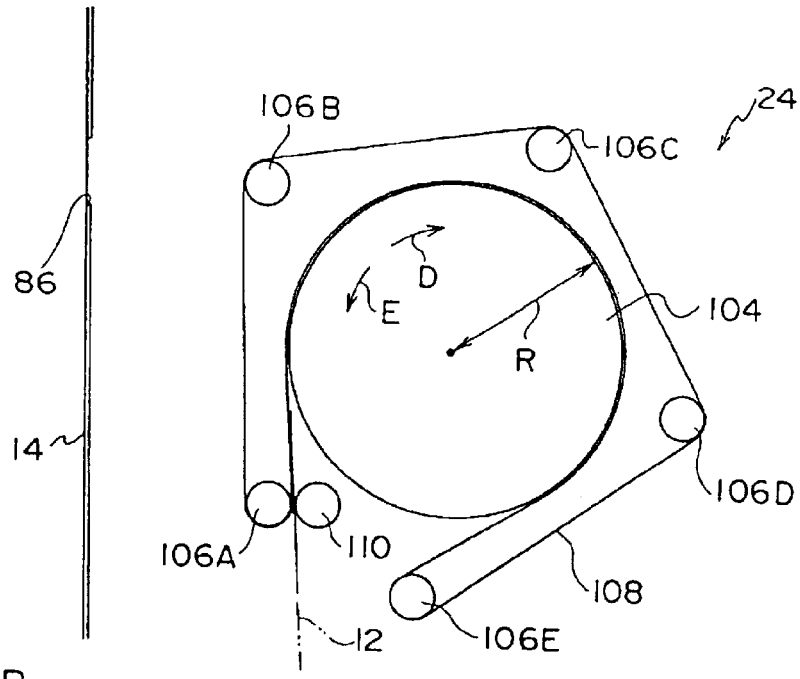
FIG. 8A is a schematic structural diagram of a discharging buffer section at the time the printing plate is received from the recording section.
Figure 8B:
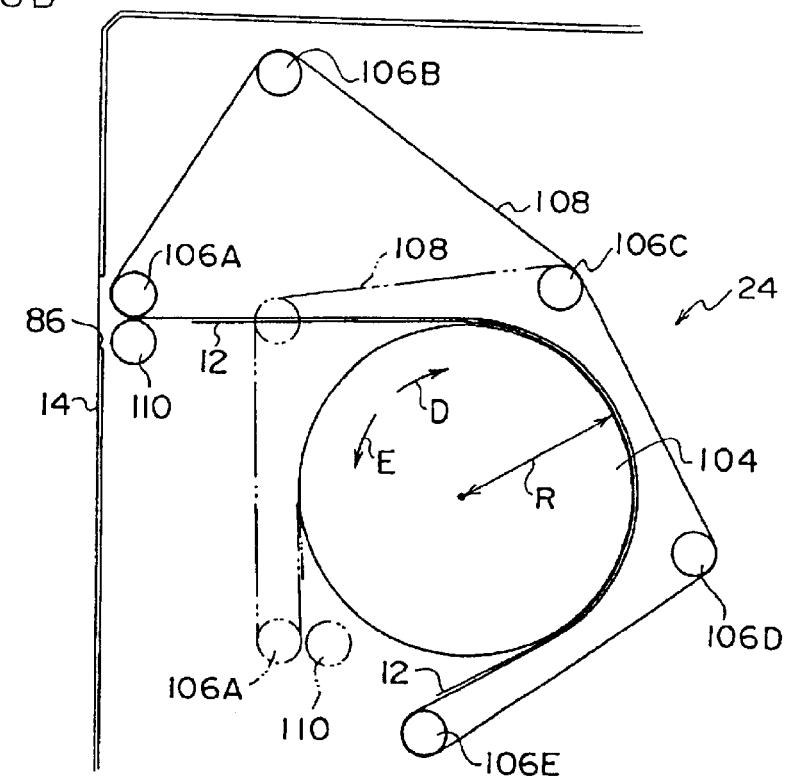
FIG. 8B is a schematic structural diagram of the discharging buffer section at the time the printing plate is sent out therefrom.

On the other hand, as shown in FIGS. 1, 8A and 8B, a discharging roller 104 is disposed at the discharging buffer section 24. This discharging roller 104 is disposed so as to oppose the discharge port 86. Small rollers 106A, 106B, 106C, 106D and 106E are disposed around the discharging roller 104.

Normally, the small rollers 106A and 106E are disposed at the lower side of the discharging roller 104, while the small rollers 106B, 106C and 106D are respectively disposed at the upper side of the discharging roller 104.

An endless conveying belt 108 is wound around these small rollers 106A, 106B, 106C, 106D and 106E. Therefore, the conveying belt 108 is wound onto approximately ¾ of the circumference of the discharging roller 104 with a lower portion of the peripheral surface of discharging roller 104 being slightly open.

The discharging roller 104 is driven by unillustrated driving means to rotate in a direction in which the printing plate 12 is taken up (i.e., in a direction of arrow D) and in a direction in which the printing plate 12 is sent out (i.e., in a direction of arrow E), respectively at a predetermined speed. The conveying belt 108 and the small rollers 106A, 106B, 106C, 106D and 106E are rotated in accordance with the rotation of the discharging roller 108.

Further, a roller 110 is disposed near the small roller 106E and opposes the small roller 106A. As shown in FIG. 1, the printing plate 12 sent out from the recording section 22 is guided by unillustrated guiding means to between the small roller 106A and the roller 110. As shown in FIG. 8A, the printing plate 12 is nipped by the small roller 106A and the roller 110, sent to between the conveying belt 108 and the discharging roller 104, and is wound onto the discharging roller 104.

The radius R of the discharging roller 104 is set on the basis of the conveying direction dimension of the printing plate 12 which is the largest among the printing plates processed in the image exposure apparatus 10. Namely, the radius R of the discharging roller 104 is set so that the printing plate 12 having the largest size can be wound onto the outer peripheral surface of the discharging roller 104. In the image exposure apparatus 10, the largest printing plate 12 has a size of 1030 mm×950 mm. In order to prevent the tendency of curling or the like from taking place when the printing plate 12 is wound onto the discharging roller 104 and is held thereon, based on the dimension of the printing plate 12 along the conveying direction thereof (i.e., 1030 mm), the radius R of the discharging roller 104 is set to be 160 mm (i.e., the diameter is 320 mm).

Accordingly, the rear end of the printing plate 12 at the time of pulling out the printing plate 12 from the cassette 16 is first inserted between the roller 106A and the roller 110 and is wound onto the discharging roller 104. When the leading end of the largest printing plate 12 passes between the small roller 106A and the roller 110, the rear end of the printing plate 12 is separated from the peripheral surface of the discharging roller 104 and is made to slightly project toward the small roller 106E. In this way, in the discharging buffer section 24, the printing plate 12 which has been sent from the recording section 22 can be wound onto the discharging roller 104 and temporarily held thereon.

On the other hand, as shown in FIGS. 1 and 8B, in the discharging buffer section 24, the small roller 106A and the roller 110 are structured so as to be integrally moved, while being rotated, to a position at which they face the discharge port 86. In other words, in the discharge buffer section 24, when the leading end of the printing plate 12 passes between the small roller 106A and the roller 110, the small roller 106A and the roller 110 are integrally moved to the position at which they face the discharge port 86. The small roller 106B disposed above the small roller 106A is urged upwards by unillustrated urging means and thereby can be moved upwards along an unillustrated guide. Therefore, accompanying the movement of the small roller 106A toward the discharge port 86, the small roller 106B is moved upwards while imparting a predetermined tension to the conveying belt 108.

By the small roller 106A being moved toward the discharge port 86, a portion of the conveying belt 108 is separated from the peripheral surface of the discharging roller 104. As a result, the leading end portion of the printing plate 12 is separated from the peripheral surface of the discharging roller 104 due to stiffness of the printing plate 12 and is directed toward the discharge port 86. In this state, in the discharging buffer section 24, the discharging roller 104 is driven to rotate in the direction in which the printing plate 12 is sent out. The printing plate 12 is nipped by the small roller 106A and the roller 110 and is sent out to the discharge port 86 while winding of the printing plate 12 onto the discharging roller 104 is released.

At this time, the discharging roller 104 is driven to rotate at a rotating speed which corresponds to a speed at which the printing plate 12 discharged from the discharge port 86 is to be conveyed in an unillustrated automatic development apparatus which is provided adjacent to the discharge port 86.

As well as the plate supplying and conveying section 20, the discharging buffer section 24 is also structured such that the conveying belt 108 contacts the photosensitive layer of the printing plate 12. Preferably, as well as the conveying belt 98 in the plate supplying and conveying section 20, the conveying belt 108 is formed of a soft material.

Operation of the present embodiment will now be described.

In the image exposure apparatus 10, image data to be recorded on the printing plate 12 by exposure is inputted, and the size and the number of the printing plates 12 which are subjected to image exposure are set. Subsequently, an instruction is given to start image exposure, and then image exposure is started. An operation panel may be provided at the image exposure apparatus so that the starting of these processings is instructed by switching operations of the operation panel. Starting of the processings in the image exposure apparatus 10 may be instructed by signals from an image processing apparatus or the like which outputs image data to the image exposure apparatus 10.

In the image exposure apparatus 10, when starting of a processing is instructed, the sheet unit 90 is moved, together with the diverting unit 88, to a position corresponding to the cassette 16 which accommodates the printing plate 12 of a specified size. Subsequently, in the image exposure apparatus 10, the printing plate 12 is taken out by the sheet unit 90 and is sent out by the diverting unit 88 toward the conveyor 26.

The conveyor 26 is driven to rotate the conveying belt 32 synchronously with the operation of the diverting unit 88. In this way, the leading end portion of the printing plate 12 which has been sent to the conveyor 26 is inserted into the opening for holding 44 of the puncher 42. When the printing plate 12 is inserted into the opening for holding 44, in the puncher 42, the notches 43A and 43B for positioning are formed at predetermined positions of the printing plate 12 by the unillustrated punching blade. The printing plate 12 is positioned relative to the puncher 42 by being positioned on, for example, the conveying belt 32 in the conveying direction and a direction orthogonal to the conveying direction, and being nipped by the rollers 30 and 34 and conveyed to a predetermined position.

After the notches 43A and 43B are formed in the printing plate 12, the conveyor 26 is driven to reverse the conveying belt 32 as well as the rollers 30 and 34 so that the leading end portion of the printing plate 12 is pulled out of the opening for holding 44 of the puncher 42. The rollers 30 and 34 side of the conveyor 26 is swung downwards by the unillustrated swinging means so that the leading end portion of the printing plate 12 is directed toward the peripheral surface of the rotating drum 38. Then, the printing plate 12 is sent out toward the peripheral surface of the rotating drum 38.

In this way, the leading end portion of the printing plate 12 is inserted between the clamp portion 50 of the leading end chuck 46 which is provided on the rotating drum 38, and the peripheral surface of the rotating drum 38, and is held therebetween in a nipped manner.

In the recording section 22, after the leading end portion of the printing plate 12 is held on the rotating drum 38, the rotating drum 38 is rotated in the direction in which the printing plate 12 is mounted and exposed, at a rotating speed which corresponds to a speed at which the printing plate 12 is conveyed by the conveying belt 32, such that the printing plate 12 is wound onto the rotating drum 38. At this time, the printing plate 12 is made to closely contact the peripheral surface of the rotating drum 38 by being pressed by the squeeze roller 60 toward the peripheral surface of the rotating drum 38.

Further, in the recording section 22, when the rear end portion of the printing plate 12 wound onto the rotating drum 38 has reached a position facing the rear end chuck mounting and dismounting unit 62, the rear end chuck 68 is mounted onto the rotating drum 38. In this way, the rear end portion of the printing plate 12 is held between the clamp portion 72 of the rear end chuck 68 and the rotating drum 38 in a nipped manner.

In the recording section 22, after being wound onto the peripheral surface of the rotating drum 38 and held thereon in the above-described manner, the printing plate 12 is subjected to scanning exposure by being irradiated with a light beam emitted from the recording head 40 and modulated based on image data, while the rotating drum 38 is rotated in the direction in which the printing plate 12 is mounted and exposed at a predetermined rotating speed (i.e., at a scanning speed of the printing plate 12).

In the recording section 22, when the image exposure on the printing plate 12 is completed, the rotating drum 38 is stopped at the position at which the rear end chuck 68 faces the rear end chuck mounting and dismounting unit 62. The rear end portion of the printing plate 12 is nipped by the squeeze roller 60 and the rotating drum 38, and the rear end chuck 68 is dismounted from the rotating drum 38. Subsequently, by the rotating drum 38 being rotated in the direction in which the printing plate 12 is taken out, the rear end portion of the printing plate 12 is sent out to the discharging buffer section 24. In the recording section 22, when the leading end chuck 46 has reached a predetermined position facing the detaching cam 64, the detaching cam 64 is operated so that holding of the leading end portion of the printing plate 12 is released.

The rear end portion of the printing plate 12 which has been sent out from the recording section 22 is pulled in to the discharging buffer section 24 by being nipped by the small roller 106A and the roller 110. When the printing plate 12 is completely separated from the recording section 22, the small roller 106A and the roller 110 are moved to a position where they face the discharge port 86. The discharging roller 104 is driven to rotate in the direction in which the printing plate 12 is sent out at a rotating speed corresponding to the speed at which the printing plate 12 is conveyed in the unillustrated automatic development apparatus, and the printing plate 12 is thereby sent out from the discharge port 86.

In the image exposure apparatus 10, when a plurality of cassettes 16 are loaded in the cassette loading section 18, the respective cassettes 16 are inclined at a predetermined angle θ (see FIG. 1). The cassettes 16 are inclined so as to be almost upright. In this way, the plurality of cassettes 16 can be loaded in a small installation area.

In the image exposure apparatus 10, the plate supplying and conveying section 20 which includes the diverting unit 88 and the sheet unit 90 is provided above the cassette loading section 18. The diverting unit 88 and the sheet unit 90 are integrally moved horizontally above the cassette loading section 18 so that the printing plate 12 can be taken out from any of the plurality of cassettes 16.

The sheet unit 90, after being moved to a position corresponding to a predetermined cassette 16, sucks the uppermost printing plate 12 by the suckers 100 and moves the plate 12 substantially upwards. As a result, the leading end portion of the printing plate 12 which is sucked by the suckers 100 is inserted between the diverting roller 94 and the conveying belt 98 of the diverting unit 88. In the plate supplying and conveying section 20, the printing plate 12 is nipped by the diverting roller 94 and the conveying belt 98 so that the rear end portion of the printing plate 12 is pulled out from the cassette 16.

Moreover, the printing plate 12 is conveyed in a curved manner by the diverting roller 94 while being uniformly pressed against the diverting roller 94 by the conveying belt 98. At this time, by the conveying belt 98 being wound onto the diverting roller 94 in the range of approximately ½ of the circumference thereof, the printing plate 12 is diverted and is sent out toward the conveyor 26.

In this way, in the image exposure apparatus 10, the diverting roller 94 is provided at the plate supplying and conveying section 20, and the printing plate 12 is conveyed in a curved manner along the periphery of the diverting roller 94 and is sent out toward the conveyor 26. Therefore, the space of the apparatus in the direction of the height thereof, in which the printing plate 12 is pulled out from the cassette 16, can be made small (i.e., the height of the apparatus can be lowered).

Namely, if the printing plate 12 were pulled out, without being curved, from the cassette 16 which is loaded in a substantially vertical state, a space corresponding to at least the longitudinal length of the printing plate 12 would be necessary above the cassette 16. Accordingly, the cassette loading section 18 would have a height which is two times or more that of the printing plate 12.

However, in the image exposure apparatus 10, the printing plate 12 which has been pulled out from the cassette 16 is curved by the diverting roller 94. Thus, a large space is not necessary above the cassette loading section 18. Accordingly, in order to reduce the installation area, even with the structure in which the cassette 16 is inclined so as to be almost upright, the height of the entire apparatus can be suppressed to a low height.

The diverting roller 94 has an outer diameter which is larger than the allowable curvature diameter of the printing plate 12 in a curved state. Therefore, even if the printing plate 12 is curved, damages such as folds, tendency to curl, cracks on the photosensitive layer, or the like are not generated on the printing plate 12. Further, in the diverting unit 88, the conveying belt 98 which is formed of a soft material contacts the photosensitive layer side of the printing plate 12. Thus, no damages such as scratches are caused on the photosensitive layer.

Further, in the diverting unit 88, the conveying belt 98 is wound onto the diverting roller 94 between the small rollers 96A and 96D, and the printing plate 12 is pressed by the conveying belt 98 against the peripheral surface of the diverting roller 94. In this way, the printing plate 12 wound onto the diverting roller 94 is uniformly pressed in its entirety so as to be smoothly curved. As a result, compared with a case in which, for example, a large number of rollers are disposed around the diverting roller 94 and the printing plate 12 is wound onto the diverting roller 94 by the rollers, formation of folds or the like can be reliably suppressed.

An example of the process for discharging the printing plate 12, which has been subjected to image exposure, at a speed corresponding to the speed at which the printing plate 12 is conveyed in the automatic development apparatus or the like disposed adjacent to the discharge port 86, is a process in which the speed at which the printing plate 12 is sent out from the recording section 22 is made to correspond to the speed at which the printing plate 12 is conveyed in the automatic development apparatus or the like. In this case, however, the speed at which the printing plate 12 is sent out from the recording section 22 needs to be changed in accordance with the speed at which the printing plate 12 is conveyed in the automatic development apparatus or the like, and this is substantially difficult. Further, in this process, unless the printing plate 12 is discharged, a subsequent printing plate 12 cannot be mounted onto the rotating drum 38.

Moreover, there is also a process in which, after the printing plate 12 has been completely separated from the recording section 22, the speed at which the printing plate 12 is conveyed is changed, and then the printing plate 12 is discharged from the discharge port 86. In this process, however, since the printing plate 12 is not curved and is made straight, a large space is necessary inside the apparatus, thereby leading to the apparatus being large.

In contrast, in the image exposure apparatus 10, the discharging roller 104 is provided at the discharging buffer section 24, and the conveying belt 108 is wound onto the discharging roller 104 in the range of approximately ¾ of the circumference thereof. Further, the radius R of the discharging roller 104 is set in accordance with the length of the printing plate 12 of the largest size along the conveying direction thereof. As a result, in the discharging buffer section 24, the printing plate 12 sent out from the recording section 22 is wound onto the discharging roller 104 so as to be temporarily held thereon.

Accordingly, in the image exposure apparatus 10, the printing plate 12 can be discharged to the discharge port 86 in a small space and at a speed corresponding to the speed at which the printing plate 12 is conveyed in the automatic development apparatus or the like disposed adjacent to the discharge port 86. Moreover, in the image exposure apparatus 10, the printing plate 12 can be mounted onto the rotating drum 38 in the recording section 22 while another printing plate 12 is discharged from the discharge port 86. Therefore, the cycle in which the printing plate 12 is exposed can be shortened.

As described above, in the image exposure apparatus 10 used in the present embodiment, the cassette 16 is loaded in the cassette loading section 18 in such a manner to be inclined at a predetermined angle. Further, the diverting unit 88 in which the printing plate 12 is diverted in a curved manner is provided at the plate supplying and conveying section 20, and the discharging roller 104 on which the printing plate 12 is wound and temporarily held is provided at the discharging buffer section 24. Thus, height for installation, as well as the installation area, of the apparatus can be lowered, and the apparatus can be made compact.

The present embodiment which has been heretofore described is merely an example of the invention, and therefore is not intended to limit the structure of the present invention. For example, the inclination angle θ of the cassette 16 loaded in the cassette loading section 18 is preferably in the range greater than or equal to 45° to less than 90° relative to the horizontal direction. However, in order to reduce the installation area, the inclination angle θ in the range greater than or equal to 60° to less than 90° is more preferable.

Moreover, the diverting roller 94 of the diverting unit 88 provided at the plate supplying and conveying section 20 may have any radius as long as damages such as folds, tendency to curl, cracks on the photosensitive layer, or the like are not caused on the printing plate 12 when the printing plate 12 is curved.

Further, in the discharging buffer section 24, the conveying belt 108 is wound onto the discharging roller 104 within the winding range thereof, which is approximately ¾ of the discharging roller 104. However, the present invention is not limited to this structure.

Figure 9:
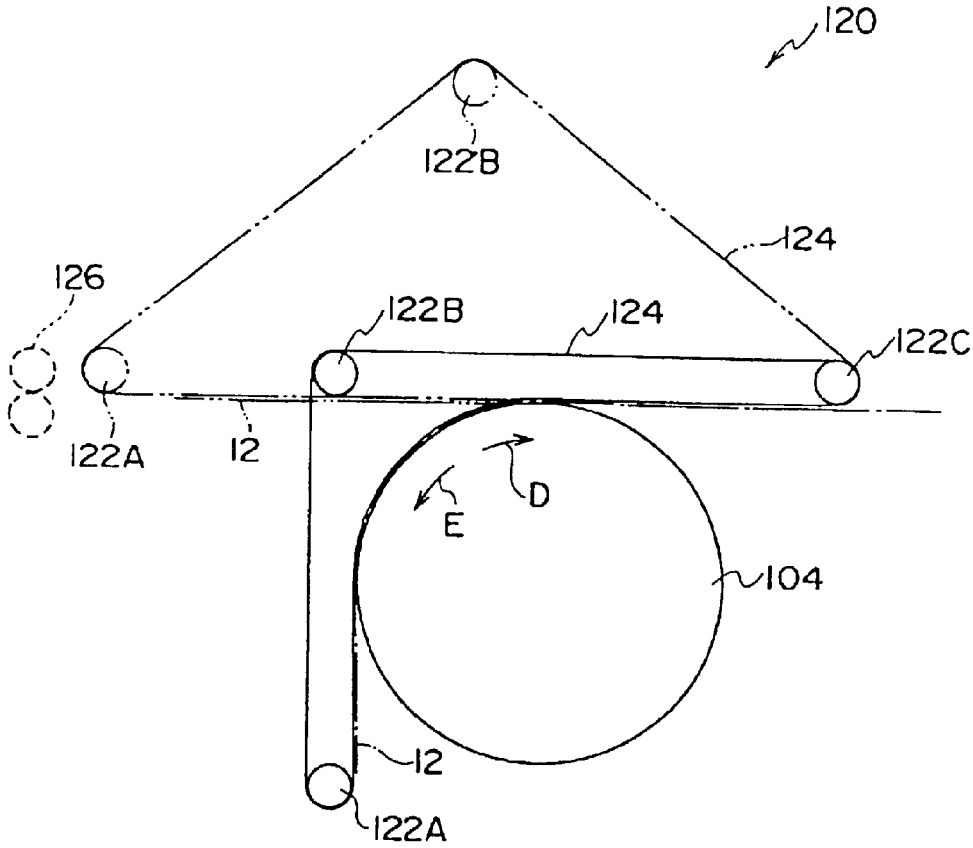
FIG. 9 is a schematic structural diagram showing a discharging buffer section of another embodiment of the present invention.

For example, a discharging buffer section 120 which can be disposed in place of the discharging buffer section 24 is shown in FIG. 9. In this discharging buffer section 120, small rollers 122A, 122B and 122C are disposed around the disposing roller 104 so as to be substantially L-shaped. A conveying belt 124 is wound onto the discharging roller 104 in the range of approximately ¼ of the circumference thereof by being wound onto these small rollers 122A, 122B and 122C.

Further, in the discharging buffer section 120, the small roller 122A is moved toward a pair of discharging rollers 126 disposed adjacent to the discharge port. Furthermore, the small roller 122B is moved synchronously with the movement of the small roller 122A so that the conveying belt 124 becomes straight between the small rollers 122A and 122B while contacting the peripheral surface of the discharging roller 104.

In the discharging buffer section 120 having the above-described structure, the printing plate 12 which has been sent out from the recording section 22 is sent between the discharging roller 104 and the conveying belt 124 from the small roller 122A side, and is diverted by being wound onto the discharging roller 104 in the range of approximately ¼. Subsequently, the printing plate 12 is made substantially straight by the small roller 122A being moved to a position at which the small roller 122A faces the pair of discharging rollers 126, and is nipped by the pair of discharging rollers 126 and discharged by driving the discharging roller 104 in the direction in which the printing plate is sent out. In case of the above structure, it is preferable that a guide roller or the like is appropriately disposed in order to prevent the bending of the printing plate 12.

As described above, the discharging buffer section used in the present invention may have any structure as long as it curves a portion of the printing plate 12 at least when the printing plate 12 is pulled in from the recording section 22 or is discharged to the discharge port 86. In this way, in the structure where the printing plate 12 is pulled above the recording section 22, for example, at least the space above the recording section 22 can be made small. Further, in a structure where the printing plate 12 is pulled from the recording section 22 in the horizontal direction, at least the installation area can be decreased.

The present embodiment is structured such that the small rollers 96A, 96B, 96C and 96D are disposed around the diverting roller 94 in a predetermined range, and the printing plate 12 is diverted by being sent to between the conveying belt 98 which is wound onto the small rollers 96A, 96B, 96C and 96D, and the diverting roller 94. However, the structure of the diverting and conveying means is not limited to this structure.

Figure 10A:
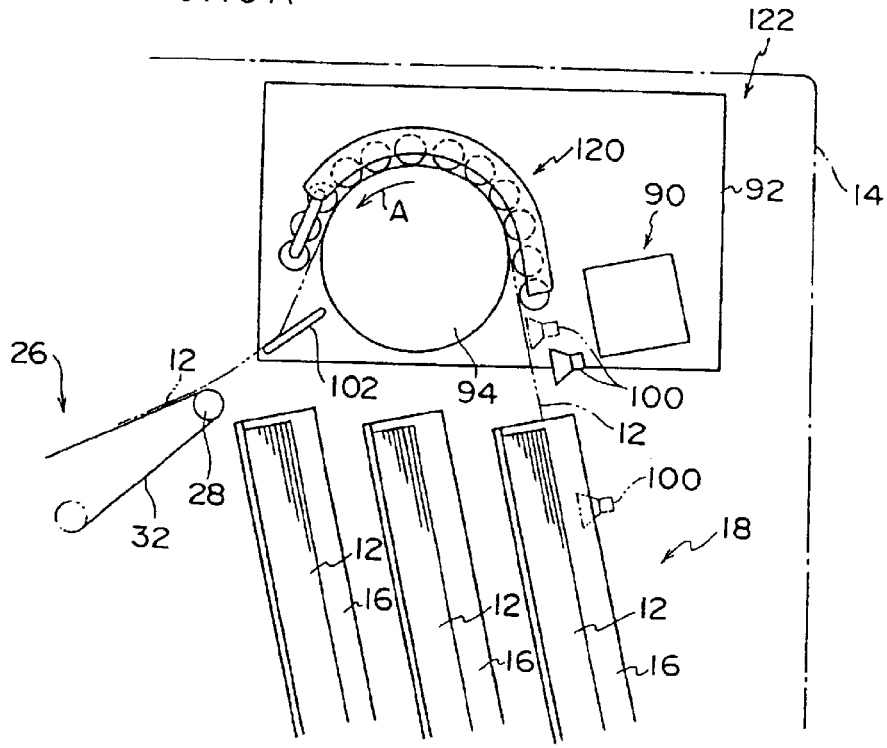
FIG. 10A is a schematic structural diagram showing another embodiment of a plate supplying and conveying section, in which a printing plate is taken out from a cassette located at a machine frame side of the plate supplying and conveying section.
Figure 10B:
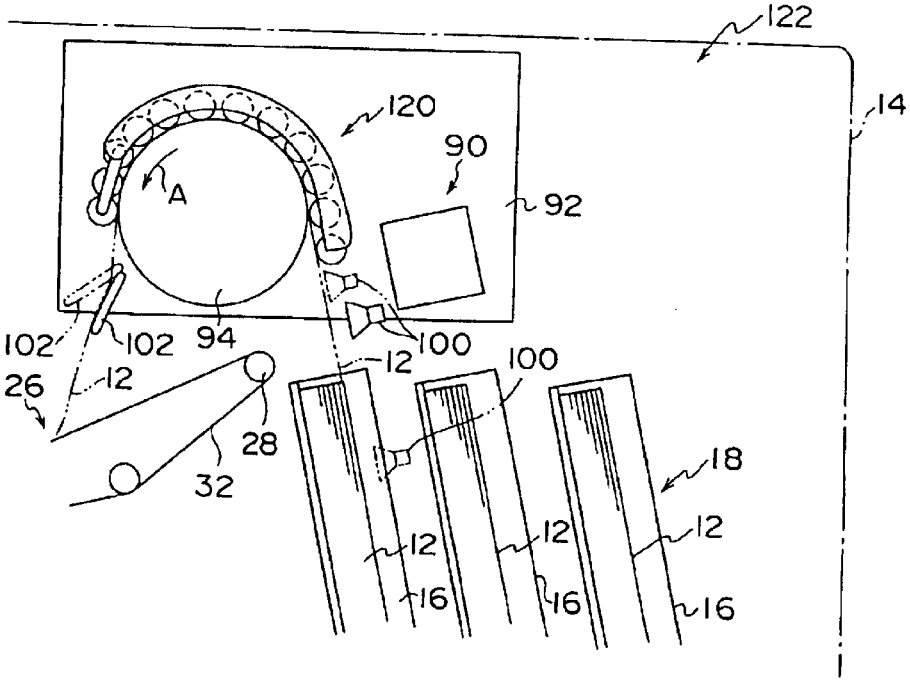
FIG. 10B is a schematic structural diagram showing how a printing plate is taken out from a cassette located at a recording section side of the plate supplying and conveying section in FIG. 10A.

For example, as shown in FIGS. 10A and 10B, a plate supplying and conveying section 122 which has a roller guide 120 around the diverting roller 94 may be used. The roller guide 120 which is provided at the plate supplying and conveying section 122 is structured so as to include a number of guide rollers 124. The guide rollers 124 are disposed close to each other around the diverting roller 94 in a predetermined range, and are independently rotated together with the diverting roller 94.

With this structure, the leading end portion of the printing plate 12 which has been pulled out from the cassette 16 by the sheet unit 90 is sent to between the diverting roller 94 and the guide rollers 124, and is nipped therebetween. In this state, by driving to rotate the diverting roller 94, the printing plate 12 is wound onto the diverting roller 94 while being pulled out from the cassette 16, and is diverted toward the conveyor 26.

At this time, the roller guide 120 is preferably structured such that end portion thereof at the side of the guide 102 can be swung in the directions toward and away from the diverting roller 94 in accordance with the position of the cassette 16 from which the printing plate 12 is to be taken out. In this way, the printing plate 12 which has been diverted by the diverting roller 94 can be securely sent out toward the guide 102.

Further, in the present embodiment, there has been described, as an example, the image exposure apparatus 10 which includes the cassette loading section 18 which accommodates the cassettes 16, each accommodating the printing plates 12, in an inclined manner. However, image exposure apparatuses to which the present invention is applied are not limited to the same.

Figure 11:
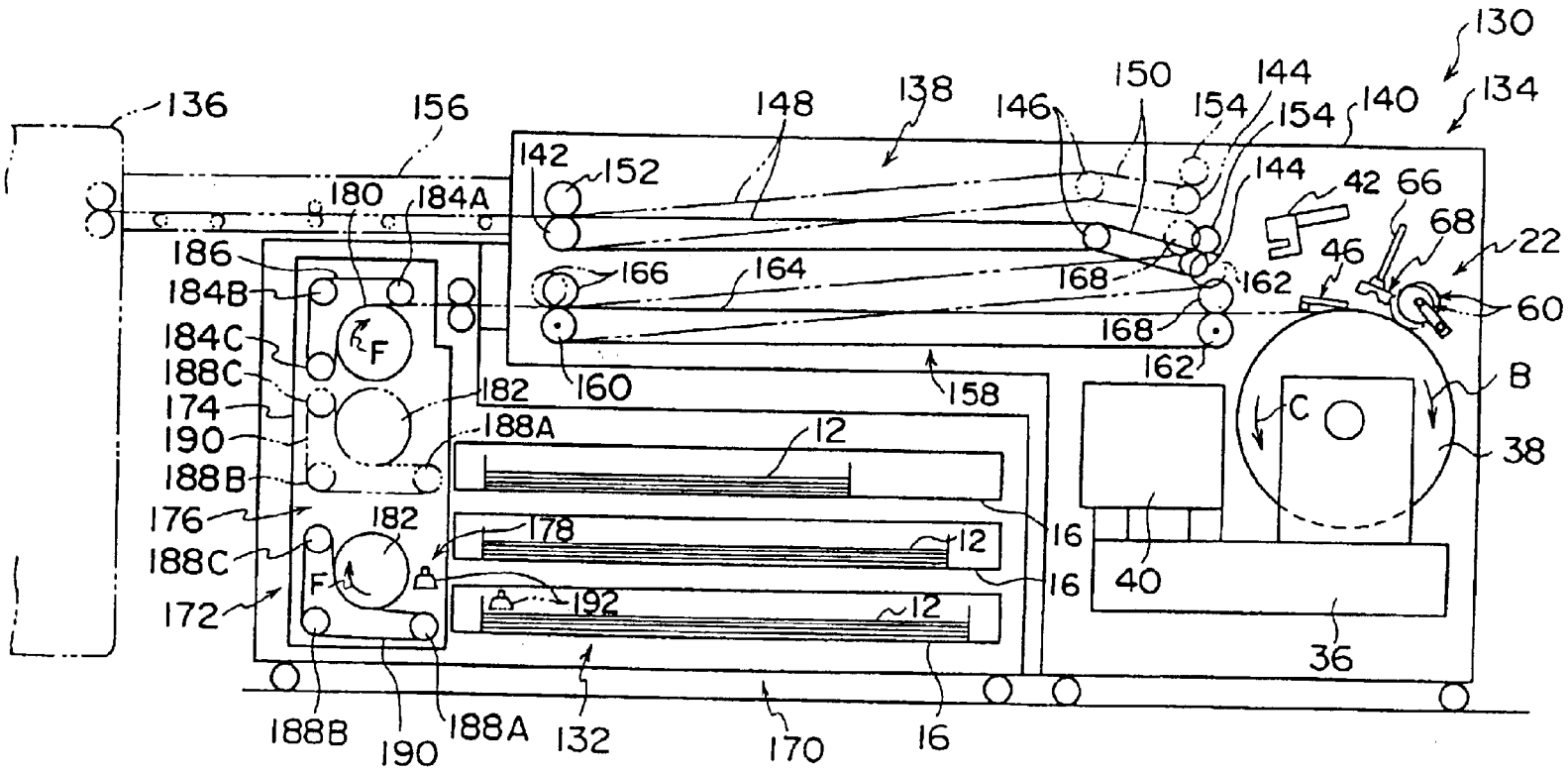
FIG. 11 is an overall schematic structural diagram showing another embodiment of the image exposure apparatus to which the present invention is applied.
Figure 12A:
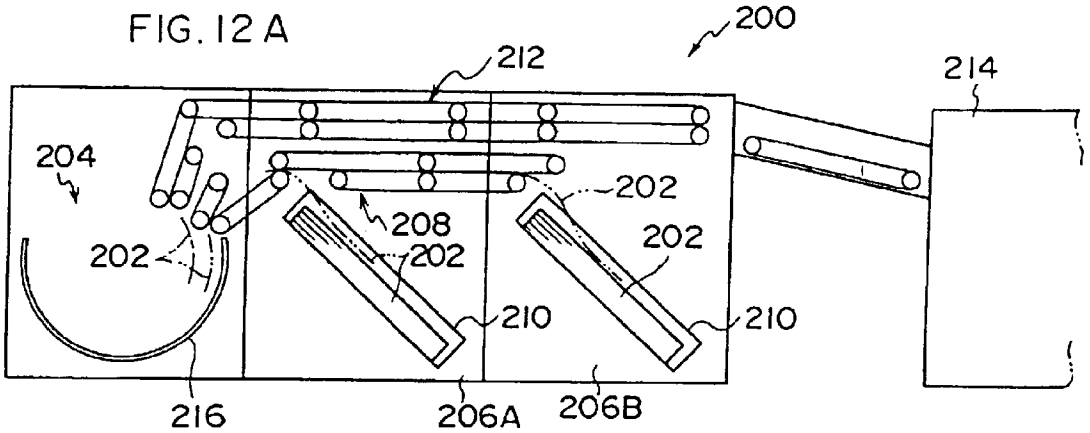
FIG. 12A is a schematic structural diagram showing an example of conventional image exposure apparatuses.
Figure 12B:
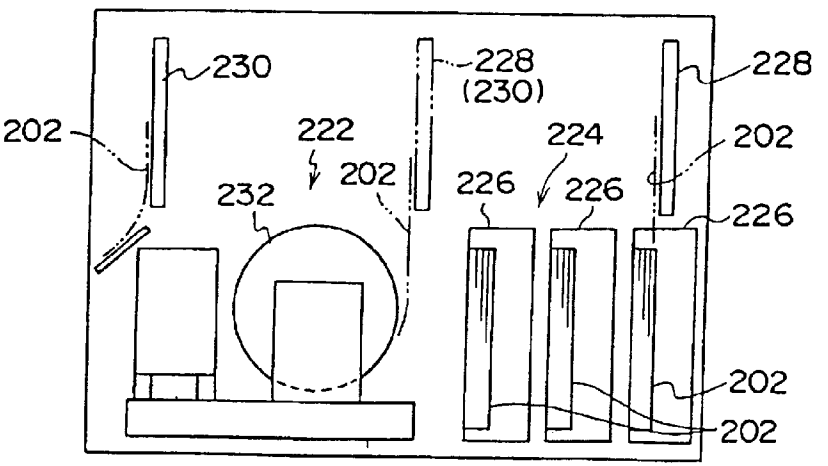
FIG. 12B is a schematic structural diagram showing another example of conventional image exposure apparatuses.

For example, a structure which is similar to an image exposure apparatus 130 shown in FIG. 11 may be used. The image exposure apparatus 130 includes a cassette loading section 132 in which the cassettes 16 each accommodating the printing plates 12 are loaded so as to be superposed in a substantially horizontal manner.

The recording section 22 is provided at a main body 134 of the image exposure apparatus 130. Further, at the main body 134, there is provided a discharging buffer section 138 which sends out the printing plates 12 which have been subjected to image exposure to an automatic development apparatus 136. Therefore, in the image exposure apparatus 130, a machine frame 140 extends toward the automatic development apparatus 136.

A roller 142 is provided at the automatic development apparatus 136 side end portion of the discharging buffer section 138, and a roller 144 is provided at the recording section 22 side of the discharging buffer section 138. Further, a roller 146 is provided between the rollers 142 and 144, and endless conveying belts 148 and 150 are wound onto the rollers 142 and 146, and onto the rollers 144 and 146, respectively. Furthermore, the rollers 142 and 144 face rollers 152 and 154, respectively, and the printing plate 12 can be nipped between the rollers 142 and 152, and between the rollers 144 and 154.

The printing plate 12 which has been subjected to image exposure is sent to between the rollers 144 and 154 from the recording section 22. In this way, the printing plate 12 is sent onto the conveying belt 150, and is conveyed to between the rollers 142 and 152 by the conveying belts 150 and 148. At this time, the printing plate 12 is conveyed at a speed which corresponds to the speed at which the printing plate 12 is sent out from the recording section 22.

Moreover, the discharging buffer section 138 has such a length that, when the printing plate 12 is nipped by the rollers 142 and 152, the rear end portion of the printing plate 12 is removed from the recording section 22. Therefore, in the discharging buffer section 138, when the leading end portion of the printing plate 12 is nipped by the rollers 142 and 152, the conveying speed is changed, and the printing plate 12 is sent out at a speed which corresponds to the speed at which the printing plate 12 is conveyed in the automatic development apparatus 136. A conveying duct 156 is provided between the machine frame 140 and the automatic development apparatus 136, and the printing plate 12 which has been sent out from the discharging buffer section 138 is conveyed through the conveying duct 156 and is sent to the automatic development apparatus 136.

In the machine frame 140, a conveyor 158 is provided below the discharging buffer section 138. At the conveyor 158, an endless conveying belt 164 is wound onto a roller 160 which is disposed below the roller 142 in the discharging buffer section 138, and a roller 162 at the recording section 22 side. Further, rollers 166 and 168 are provided at the conveyor 158 so as to face the rollers 160 and 162, respectively.

The printing plate 12 is sent to the main body 134 of the image exposure apparatus 130 in such a manner as to be inserted between the rollers 160 and 166 from below the conveying duct 156. The printing plate 12 is conveyed on the conveyor 158 toward the recording section 22.

As shown in a two dot chain line in FIG. 11, the conveyor 158 can be swung with the roller 160 at the printing plate 12 inserting side of the conveyor 158, for example, serving as an axis, such that the roller 162 side of the conveyor 158 faces the puncher 42. When the leading end portion of the printing plate 12 is nipped by the rollers 162 and 168, the conveyor 158 is swung so as to direct the leading end portion of the printing plate 12 toward the puncher 42, and sends it out toward the opening for holding 44 of the puncher 42.

Further, after the notches 43A and 43B have been formed by the puncher 42 in the leading end portion of the printing plate 12, the conveyor 158 pulls out the printing plate 12 from the puncher 42. Subsequently, the conveyor 158 is swung so as to direct the leading end portion of the printing plate 12 toward the printing plate mounting position on the rotating drum 38 and sends it out toward the recording section 22. As shown in the two dot chain line in FIG. 11, the discharging buffer section 138 is structured so that the rollers 144 and 146 are moved in accordance with the swinging of the conveyor 158.

The cassette loading section 132 is provided inside a container 170 and is disposed below the conveyor 158. In this cassette loading section 132, the plurality of cassettes 16 each accommodating the printing plates 12 are loaded so as to be superposed in a substantially horizontal manner.

Moreover, a plate supplying and conveying section 172 is provided within the container 170 so as to connect one end portion of each of the cassettes 16 to the printing plate inserting side of the main body 134.

A diverting unit 176 and a sheet unit 178 are provided at a side plate 174 of the plate supplying and conveying section 172. The diverting unit 176 includes a diverting roller 180 which is disposed at the upper portion of the side plate 174 so as to face the conveyor 158, and a diverting roller 182 which is disposed below the diverting roller 180 and can be moved vertically. As in the case with the diverting roller 94, the diverting rollers 180 and 182 each have an outer diameter which generates no folds and tendency to curl on the printing plate 12 or causes no damages such as cracks or the like on the photosensitive layer of the printing plate 12.

Small rollers 184A, 184B and 184C are provided around the diverting roller 180, and an endless conveying belt 186 is wound onto them. The small roller 184A is disposed close to the conveyor 158, while the smaller roller 184C is disposed close to the diverting roller 182. In this way, the conveying belt 186 is wound onto about ¼ of the circumference of the diverting roller 180.

Moreover, small rollers 188A, 188B and 188C are provided around the diverting roller 182, and an endless conveying belt 190 is wound onto them. The small roller 188A is disposed close to the cassette loading section 132, and the small roller 188C is disposed close to the diverting roller 180. In this way, the conveying belt 190 is wound onto about ¼ of the circumference of the diverting roller 182 between the small rollers 188A and 188C.

The sheet unit 178 has a sucker 192 whose original position is a position where it faces the small roller 188A. The sucker 192 is moved between the original position and a printing plate sucking position (shown in a two dot chain line in FIG. 11) where the sucker 192 faces the leading end portion of the printing plate 12 accommodated in the cassette 16 (i.e., the end portion of the printing plate 12 at the plate supplying and conveying section 172 side), and sucks the printing plate 12 in the cassette 16.

In the sheet unit 178, the leading end portion of the printing plate 12 in the cassette 16 is sent to between the diverting roller 182 and the conveying belt 190 by the sucker 192 which has sucked the printing plate 12 being returned to its original position.

In the diverting unit 176, once the leading end portion of the printing plate 12 is sent to between the diverting roller 182 and the conveying belt 190, the diverting rollers 180 and 182 are driven to rotate in a direction in which the printing plate 12 is conveyed (i.e., in a direction of arrow F). As a result, the printing plate 12 is curved along the circumference of the diverting roller 182 while being pulled out from the cassette 16, and is diverted and sent out toward the diverting roller 180.

The printing plate 12 which has been sent out from between the diverting roller 182 and the conveying belt 190 is sent to between the diverting roller 180 and the conveying belt 186. At this time, by the diverting roller 180 being rotated synchronously with the diverting roller 182, the printing plate 12 is nipped between the diverting roller 180 and the conveying belt 186, is curved along the circumference of the diverting roller 180, and is diverted toward the conveyor 158. As a result, the printing plate 12 which has been sent out from between the diverting roller 180 and the conveying belt 186 is sent to between the rollers 160 and 166 of the conveyor 158, and is pulled onto the conveyor 158.

In the diverting unit 178, the diverting roller 182, and the small rollers 188A, 188B and 188C around the diverting roller 182 are vertically moved together with the sucker 192 of the sheet unit 178 so as to face the respective cassettes 16 accommodated in the cassette loading section 132 (see solid lines and two dot chain lines in FIG. 11).

In this way, the diverting roller 182 can face any of the cassettes 16 which are loaded in a horizontally superposed manner in the cassette loading section 132. In the plate supplying and conveying section 172, the printing plate 12 can be taken out from any of the cassettes 16 which are loaded in the cassette loading section 132.

In the image exposure apparatus 130 having the above-described structure, even if the cassettes 16 each accommodating the printing plates 12 are disposed horizontally, space required for pulling out the printing plate 12 from the cassette 16 can be decreased. Accordingly, even if the cassettes 16 each accommodating the printing plates 12 are disposed in a substantially horizontal manner, installation space can be suppressed.

In the present embodiment described above, there has been described, as an example, the image exposure apparatus 10 in which the printing plate 12, formed in such a manner that a photosensitive layer is formed on an aluminum support, is used and is subjected to image exposure processing. However, the image exposure apparatus to which the present invention is applied can be used for various types of image exposure apparatuses in which image exposure is carried out on a printing plate in which a photosensitive layer is formed on a support in the form of a metal sheet.

As described above, in accordance with the present invention, there can be obtained effects that, by providing diverting and conveying means which includes the diverting roller facing the printing plate loading section, the image exposure apparatus can be made compact, and the printing plates can be smoothly pulled out and conveyed without damages being caused thereon.

Moreover, in the present invention, the apparatus can be made small by the printing plate sent out from the image recording section being received in the discharging buffer section in a curved manner. Further, the printing plate can be smoothly sent out at a speed which corresponds to the speed at which the printing plate is conveyed in an automatic development apparatus or the like which is disposed for the subsequent process.

What is claimed is:

1. An image exposure apparatus for carrying out image exposure on a sheet material, comprising:

a recording section which records an image on the sheet material by exposing the sheet material;

an accommodating section which is disposed adjacent to the recording section and accommodates a plurality of sheet materials in such a manner that the plurality of sheet materials are inclined at a predetermined angle (θ) relative to a horizontal plane including a bottom supporting surface of said image exposure apparatus; and a diverting section which is disposed above the accommodating section, and diverts the sheet material received from the accommodating section and conveys it to the recording section; wherein the diverting section can be selectively moved to respective positions each corresponding to an exit for sheets above the cassette.

2. The apparatus of claim 1, wherein the angle (θ) of the sheet material is in the range greater than or equal to 45° to less than 90° relative to the horizontal plane including the bottom supporting surface of said image exposure apparatus.

3. The apparatus of claim 1, wherein the accommodating section can accommodate a plurality of cassettes disposed parallel to each other, each of the plurality of cassettes being able to accommodate the plurality of sheet materials.

4. The apparatus of claim 3, wherein the diverting section includes at least one sucker for moving at least one of said plurality of sheet materials from said each of the plurality of cassettes to the diverting section.

5. The apparatus of claim 4, wherein said at least one sucker is positioned along a transverse direction of said plurality of sheet materials.

6. The apparatus of claim 4, wherein said at least one sucker faces and sucks an upper end portion of said at least one of said plurality of sheet materials when performing the moving operation.

7. The apparatus of claim 6, wherein said at least one sucker sucks a side of said at least one of said plurality of sheet materials on which a photosensitive layer is formed.

8. The apparatus of claim 1, wherein the diverting section diverts the sheet material by conveying it in such a manner that the sheet material is curved at a predetermined radius of curvature.

9. The apparatus of claim 1, wherein the diverting section includes a diverting roller which is rotated for diverting the sheet material, and the sheet material is wound onto the outer peripheral surface of the diverting roller.

10. The apparatus of claim 1, further comprising a discharging section which is disposed above the recording section for diverting the sheet material received from the recording section and discharging the sheet material to the outside of the apparatus.

11. The apparatus of claim 1, wherein said exposing the sheet material further includes scanning exposure by a light beam.

12. An image exposure apparatus for carrying out image exposure on a printing plate including a support in the form of a metal sheet and a photosensitive layer formed on the support, comprising:

an image recording section for recording an image on the printing plate by exposing the printing plate;

an accommodating section for accommodating a plurality of printing plates; and a diverting and conveying section disposed adjacent to the accommodating section and having a diverting roller, said diverting roller having an outer circumference on which the printing plate is wound, for receiving the printing plate from the accommodating section and conveying the printing plate to the image recording section disposed adjacent to the accommodating section while curving the printing plate at a predetermined radius of curvature; wherein the diverting section can be selectively moved to respective positions each corresponding to an exit for sheets above the cassette.

13. The apparatus of claim 12, wherein the accommodating section accommodates a plurality of cassettes, each cassette being able to accommodate a plurality of printing plates, and the diverting and conveying section is disposed movably for positioning the diverting and conveying section at positions corresponding to an exit for each of the cassettes.

14. The apparatus of claim 12, wherein the diverting and conveying section includes a plurality of small rollers disposed around the diverting roller in a predetermined range, and the printing plates conveyed are nipped between the diverting roller and the small rollers.

15. The apparatus of claim 12, further comprising a discharging buffer section for receiving the recorded printing plates from the image recording section and discharging the recorded printing plates at a predetermined discharging speed.

16. The apparatus of claim 15, wherein the discharging buffer section includes a rotatable discharging roller having an outer circumference on which the printing plates are wound, for sending out the printing plates in the discharging direction.

17. The apparatus of claim 16, wherein the discharging buffer section includes an endless conveying belt wound onto the discharging roller, and the printing plate is wound around a predetermined range of the circumference of the discharging roller and nipped between the discharging roller arid the conveying belt.

18. The apparatus of claim 12, wherein said exposing the sheet material farther includes scanning exposure by a light beam.

19. An image exposure apparatus for carrying out image exposure on a sheet material, comprising:

a recording section which records an image on the sheet material by exposing the sheet material;

an accommodating section which is disposed adjacent to the recording section and can accommodate a plurality of sheet materials;

a diverting section which diverts the sheet material received from the accommodation section and conveys the sheet material to the recording section; and a discharging section which is disposed above the recording section for diverting the sheet material received from the recording section and discharging the sheet material to the outside of the apparatus; wherein the diverting section can be selectively moved to respective positions each corresponding to an exit for sheets above the cassette.

20. The apparatus of claim 19, wherein the discharging section diverts the sheet material by conveying it in such a manner that the sheet material is curved at a predetermined radius of curvature.

21. The apparatus of claim 19, wherein the discharging section includes a discharging roller which is rotated for diverting the sheet material, and the sheet material is wound onto the outer peripheral surface of the discharging roller.

22. The apparatus of claim 21, wherein the discharging section includes an endless conveying belt which is wound onto a predetermined range of the circumference of the discharging roller so that the sheet material is nipped between the discharging roller and the conveying belt and is conveyed thereby.

23. The apparatus of claim 19, wherein said exposing the sheet material further includes scanning exposure by a light beam.

24. The apparatus of claim 19, wherein the diverting section further comprises a diverting roller.

25. An image exposure apparatus for carrying out image exposure on a sheet material, comprising:

a recording section which records an image on the sheet material by exposing light to the sheet material;

an accommodating section which is disposed adjacent to the recording section and accommodates a plurality of said sheet materials in such a manner that the plurality of sheet materials are inclined at a predetermined angle relative to a horizontal plane including a bottom plane surface of said image exposure apparatus;

a diverting section for diverting said sheet material received from the accommodating section and for conveying said sheet material to the recording section; and wherein the diverting section can be selectively moved to respective positions each corresponding to an exit for sheets.

* * * * *